US011499251B2

(12) United States Patent
Yenici et al.

(10) Patent No.: US 11,499,251 B2
(45) Date of Patent: Nov. 15, 2022

(54) FILAMENTARY CORE FOR AN ELASTIC YARN, ELASTIC COMPOSITE YARN, TEXTILE FABRIC AND APPARATUS AND METHOD FOR MANUFACTURING SAID ELASTIC YARN

(71) Applicant: CALIK DENIM TEKSTIL SAN. VE TIC. A.S., Istanbul (TR)

(72) Inventors: Hamit Yenici, Istanbul (TR); Ahmet Serhat Karaduman, Yesilyurt/Malatya (TR); Deniz Özkül, Malatya (TR); Yasin Cirik, Malatya (TR); Meltem Demirtas, Malatya (TR)

(73) Assignee: Calik Denim Tekstil San. Ve Tic. A.S., Istanbul (TR)

( * ) Notice: Subject to any disclaimer, the term of this patent is extended or adjusted under 35 U.S.C. 154(b) by 218 days.

(21) Appl. No.: 16/896,415

(22) Filed: Jun. 9, 2020

(65) Prior Publication Data

US 2020/0299871 A1 Sep. 24, 2020

Related U.S. Application Data

(63) Continuation of application No. 15/553,427, filed as application No. PCT/EP2016/053893 on Feb. 24, 2016, now Pat. No. 10,704,168.

(30) Foreign Application Priority Data

Feb. 24, 2015 (EP) ..... 15000532

(51) Int. Cl.
*D02G 3/32* (2006.01)
*D02G 3/36* (2006.01)
(Continued)

(52) U.S. Cl.
CPC ..... *D02G 3/32* (2013.01); *D02G 1/028* (2013.01); *D02G 3/324* (2013.01); *D02G 3/326* (2013.01);
(Continued)

(58) Field of Classification Search
CPC ..... D02G 3/326; D02G 3/328; D02G 3/32
See application file for complete search history.

(56) References Cited

U.S. PATENT DOCUMENTS 3,983,687 A 10/1976 Lewis
5,177,948 A 1/1993 Kolmes et al.
(Continued)

FOREIGN PATENT DOCUMENTS

CN 102995199 A 3/2013
EP 2006422 A1 12/2008
(Continued)

OTHER PUBLICATIONS

International Search Report and The Written Opinion of the International Search Authority dated Dec. 5, 2016, International application No. PCT/EP2016/053893.
(Continued)

*Primary Examiner* — Tajash D Patel

(57) ABSTRACT

A filamentary core for an elastic composite yarn, particularly for an elastic textile composite yarn, comprising at least two elastic performance filaments, wherein each of the at least two elastic performance filaments is capable of being stretched at least about 2 times its package length and has at least 90% up to 100% elastic recovery after having being released from a stretching 2 times its package length.

23 Claims, 19 Drawing Sheets

(51) Int. Cl.

| | |
|---|---|
| ***D02G 3/38*** | (2006.01) |
| ***D03D 15/56*** | (2021.01) |
| ***D02G 1/02*** | (2006.01) |
| ***D02G 3/44*** | (2006.01) |
| ***D04B 1/18*** | (2006.01) |
| ***D04B 21/18*** | (2006.01) |

(52) U.S. Cl.

CPC ..... *D02G 3/328* (2013.01); *D02G 3/367* (2013.01); *D02G 3/38* (2013.01); *D02G 3/44* (2013.01); *D03D 15/56* (2021.01); *D04B 1/18* (2013.01); *D04B 21/18* (2013.01); *D10B 2201/02* (2013.01); *D10B 2211/02* (2013.01); *D10B 2331/04* (2013.01); *D10B 2401/061* (2013.01); *D10B 2501/04* (2013.01)

(56) References Cited

U.S. PATENT DOCUMENTS

| | | | | |
|---|---|---|---|---|
| 5,376,118 | A | 12/1994 | Kaplan et al. | |
| 6,581,366 | B1 | 6/2003 | Andrews | |
| 10,704,168 | B2 * | 7/2020 | Yenici | D02G 3/367 |
| 2008/0268734 | A1 | 10/2008 | Tharpe et al. | |
| 2008/0318485 | A1 | 12/2008 | Cheng | |
| 2010/0281842 | A1 | 11/2010 | Tharpe, Jr. et al. | |
| 2012/0244771 | A1 | 9/2012 | Tharpe, Jr. et al. | |
| 2013/0260129 | A1 | 10/2013 | Agzikara et al. | |
| 2015/0184319 | A1 | 7/2015 | Yeung | |
| 2015/0354101 | A1 | 12/2015 | Liao et al. | |
| 2016/0208419 | A1 | 7/2016 | Tharpe, Jr. et al. | |
| 2020/0032427 | A1 * | 1/2020 | Konukoglu | D01F 8/14 |
| 2021/0047757 | A1 * | 2/2021 | Cleveland | D02G 3/36 |

FOREIGN PATENT DOCUMENTS

| | | | |
|---|---|---|---|
| EP | 2158886 | A2 | 3/2010 |
| GB | 904597 | A | 8/1962 |
| JP | 2001288637 | A | 10/2001 |
| WO | WO-2008130563 | A1 | 10/2008 |
| WO | WO-2014113207 | A1 | 7/2014 |
| WO | WO-2015003346 | A1 | 1/2015 |

OTHER PUBLICATIONS

Preliminary report on Patentability dated Sep. 8, 2017—International application No. PCT/EP2016/053893.

* cited by examiner

| EXAMPLES | Draft ratio for first filament 11 | Draft ratio for second filament 13 | (Thickness) of first filament 11 | (Thickness) of first filament 13 | Draft ratio of inelastic filament 15 | (Thickness and Type) of inelastic filament 15 | (Thickness) of yarn 1 |
|---|---|---|---|---|---|---|---|
| EXAMPLE 1 | 4,2 | 1,2 | 78DTEX | 117DTEX | 1,08 | 165DTEX T400 | 8,6NE |
| EXAMPLE 2 | 4 | 3,6 | 117DTEX | 117DTEX | X | X | 8,5NE |
| EXAMPLE 3 | 2,2 | 3,8 | 78DTEX | 78DTEX | 1,05 | 150DENYE PES | 9,7 NE |
| EXAMPLE 4 | 2,6 | 3,4 | 135DTEX | 78DTEX | X | X | 10NE |
| EXAMPLE 5 | 1,7 | 3,6 | 135DTEX | 78DTEX | 1,06 | 110DTEX PES | 10,7 NE |
| EXAMPLE 6 | 1,8 | 2,8 | 78DTEX | 78DTEX | X | X | 11NE |
| EXAMPLE 7 | 1,7 | 3,8 | 78DTEX | 135DTEX | 1,06 | 165DTEX T400 | 12,8 NE |
| EXAMPLE 8 | 2,2 | 3,4 | 78DTEX | 117DTEX | X | X | 12,6NE |
| EXAMPLE 9 | 4,2 | 3,2 | 117DTEX | 78DTEX | 1,13 | 100DENYE PES | 13NE |
| EXAMPLE 10 | 3,6 | 3,6 | 117DTEX | 117DTEX | X | X | 13NE |
| EXAMPLE 11 | 2,4 | 3,62 | 78DTEX | 117DTEX | 1,12 | 75DENYE PES | 13,4 NE |
| EXAMPLE 12 | 1,9 | 3,3 | 78DTEX | 78DTEX | X | X | 14,2NE |
| EXAMPLE 13 | 3 | 1,2 | 117DTEX | 78DTEX | 1,07 | 110DTEX PES | 15NE |
| EXAMPLE 14 | 3,8 | 3,8 | 78DTEX | 78DTEX | X | X | 16NE |
| EXAMPLE 15 | 2,6 | 3,6 | 78DTEX | 78DTEX | X | X | 16,3NE |
| EXAMPLE 16 | 4,2 | 3,2 | 117DTEX | 78DTEX | 1,15 | 100DENYE PES | 17NE |
| EXAMPLE 17 | 3,2 | 4,2 | 78DTEX | 117DTEX | 1,08 | 83DTEX T400 | 17,3NE |
| EXAMPLE 18 | 2,8 | 3,4 | 44DTEX | 78DTEX | X | X | 17,6NE |
| EXAMPLE 19 | 3,3 | 2,8 | 135DTEX | 78DTEX | 1,08 | 75DENYE PES | 17,7NE |
| EXAMPLE 20 | 2,6 | 3,6 | 117DTEX | 78DTEX | 1,05 | 55DTEX T400 | 18,1NE |
| EXAMPLE 21 | 1,8 | 4,2 | 44DTEX | 78DTEX | X | X | 18,6NE |
| EXAMPLE 22 | 3,4 | 3,4 | 44DTEX | 44DTEX | X | X | 20NE |
| EXAMPLE 23 | 2,4 | 3,3 | 78DTEX | 78DTEX | 1,06 | 100DENYE PBT | 20,4NE |
| EXAMPLE 24 | 3,2 | 3,8 | 44DTEX | 78DTEX | X | X | 22NE |
| EXAMPLE 25 | 1,8 | 3,6 | 44DTEX | 78DTEX | 1,08 | 55DTEX T400 | 24,5NE |
| EXAMPLE 26 | 3,6 | 3,4 | 78DTEX | 44DTEX | X | X | 25,3NE |
| EXAMPLE 27 | 1,7 | 3,6 | 78DTEX | 44DTEX | 1,06 | 50DENYE PBT | 26,5NE |
| EXAMPLE 28 | 2,6 | 4,2 | 44DTEX | 78DTEX | X | X | 27,4NE |
| EXAMPLE 29 | 2,3 | 3,6 | 44DTEX | 78DTEX | 1,08 | 33DTEX T400 | 28,5NE |

Fig. 23

FILAMENTARY CORE FOR AN ELASTIC YARN, ELASTIC COMPOSITE YARN, TEXTILE FABRIC AND APPARATUS AND METHOD FOR MANUFACTURING SAID ELASTIC YARN

CROSS REFERENCE TO RELATED APPLICATIONS

This patent application is a continuation patent application of U.S. patent application Ser. No. 15/553,427, filed Aug. 24, 2017, which is a National Stage application of International Patent Application No. PCT/EP2016/053893, filed on Feb. 24, 2016, which claims priority to European Patent Application No. EP 15000532.0, filed on Feb. 24, 2015, each of which is incorporated herein by reference in its entirety.

BACKGROUND

Typically yarns are typically produced by spinning fibers of wool, flex, cotton or other materials to achieve long strands which shall be called yarns or threads. Particularly, the yarn according to the present disclosure shall be used for manufacturing textiles or fabrics, particularly jean fabric, denim or dungaree. In order to provide an elastically stretchable yarn, it is known to integrate in yarns a filamentary core consisting of one or more elastic performance filaments. A yarn is a strand of a long continuous length provided on bobbins.

Usually the outside of the yarn, i.e. a sheath or coat, is realized by interlocked fibers, particularly of cotton.

WO 2008/130563 A1 discloses an elastic composite yarn consisting of a filamentary core having at least one such elastic performance filament and one inelastic control filament. Said filamentary core is surrounded by a fibrous sheath of spun-stable fibers. According to the embodiment of FIGS. 2 and 3 of WO 2008/130563 A1 the filamentary core comprises both one elastic performance filament and one inelastic control filament.

Further, from WO 2012/062480 A2 a composite stretch yarn is known comprising a filament core and a fibrous sheath surrounding the filamentary core and being made of cotton fibers. The filamentary core is realized by one elastic performance filament and one inelastic control filament. Said inelastic control filament can be a PTT/PET bicomponent elastomultiester or the like as disclosed in EP 1 846 602.

The inventor of this present disclosure found out that above-mentioned conventional elastic yarns used for manufacturing textile material like a denim fabric, suffer from a non-sufficient elastic behavior, as recovery. Elastic recovery is an important property for an elastic yarn in that the yarn is capable of regaining its original length after deformation by first applying tensile stress and further releasing said stress. If the recovery properties of the elastic yarn are not sufficient or too low, an undesired growth effect may arise. The growth effect is undesired because the elastic yarn does not provide enough elastic recovery in order to bring back the elastic yarn to its original condition before the stress was applied. Considering microscopically a fabric product, particularly trousers made of a fabric woven on the basis of elastic yarns, in highly stressed textile fabrics, as the area of knees and back a the trousers, the growth effect causes an inappropriate slaggy fit which could even make the textile product useless for the consumer. However, if the fabric as such is designed of having a stronger elastic recovery, such fabric would provide a more uncomfortable fit for the consumer particularly at areas, e.g. at arm or leg sleeves, which do not suffer the same stress peaks as at knees and back portion. This undesired, tight fit is known as "corset"-phenomenon.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1*a* is a schematic section view of an elastic composite yarn including a filamentary core according to an exemplary embodiment of the present disclosure;

FIG. 1*b* is a schematic side view of the elastic composite yarn according to FIG. 1*a;*

FIG. 2*a* is a schematic view of the elastic composite yarn including a filamentary core according to a second exemplary embodiment of the present disclosure;

FIG. 2*b* is a schematic side view of a manufacturing process step for making the elastic composite yarn according to the second embodiment;

FIG. 3*a* is a schematic section view of an elastic composite yarn including a filamentary core according to a third exemplary embodiment of the present disclosure;

FIG. 3*b* is a schematic side view of a manufacturing process step for making the elastic composite yarn according to the third embodiment in FIG. 3*a;*

FIG. 4*a* is a schematic perspective and section view of an elastic composite yarn including a filamentary core according to a fourth exemplary embodiment of the present disclosure;

FIG. 4*b* is a schematic section view of the elastic composite yarn according to FIG. 4*a;*

Figure 7:
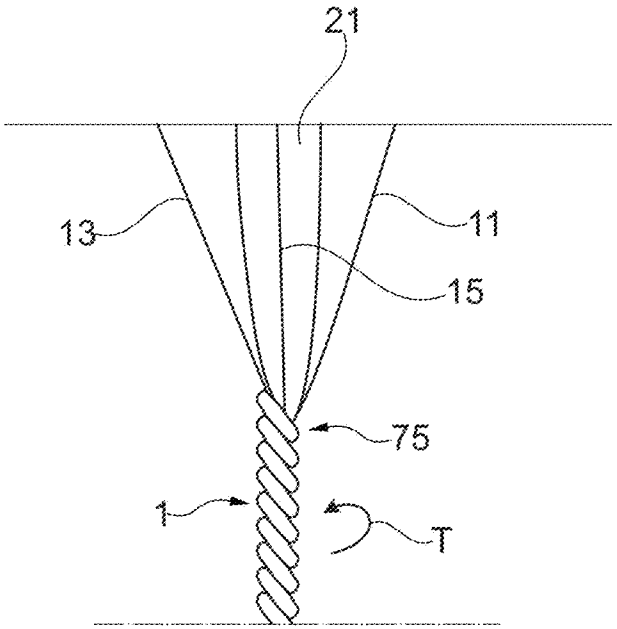
Figure 8:
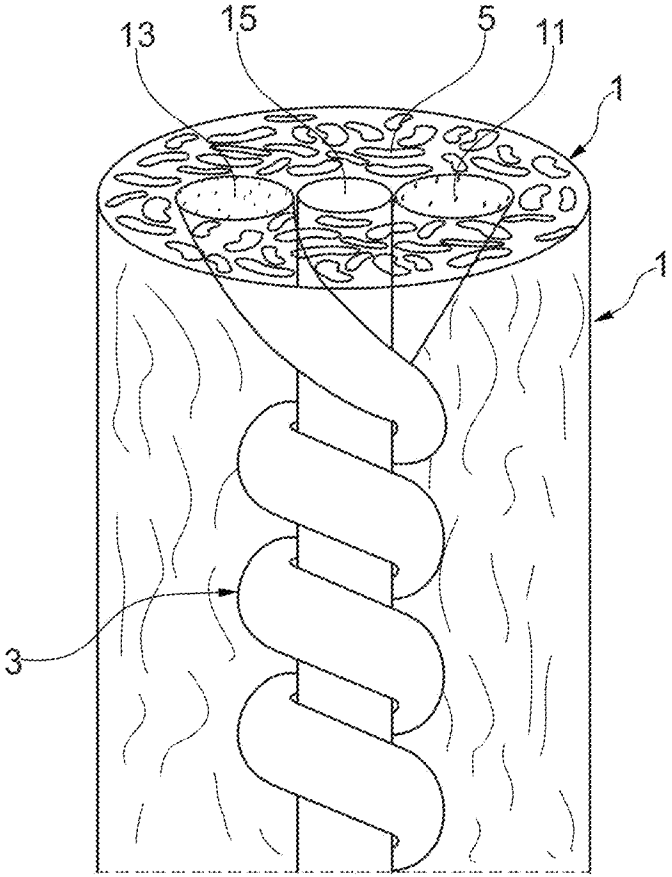
Figure 9:
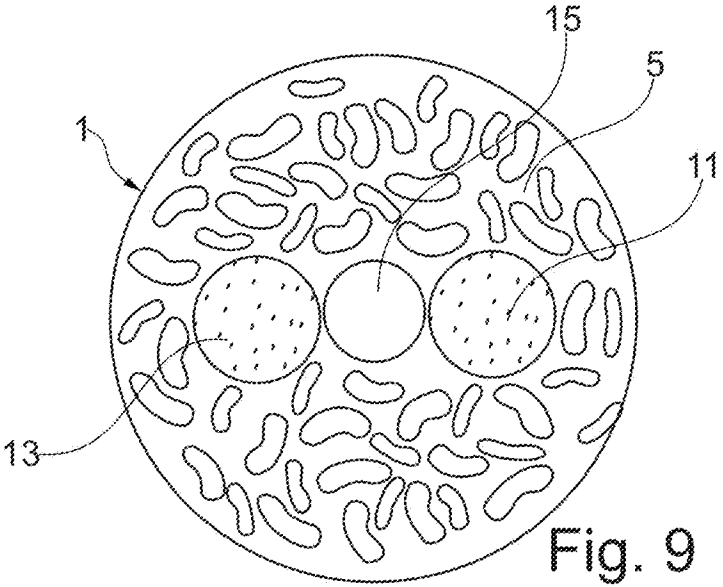
Figure 10:
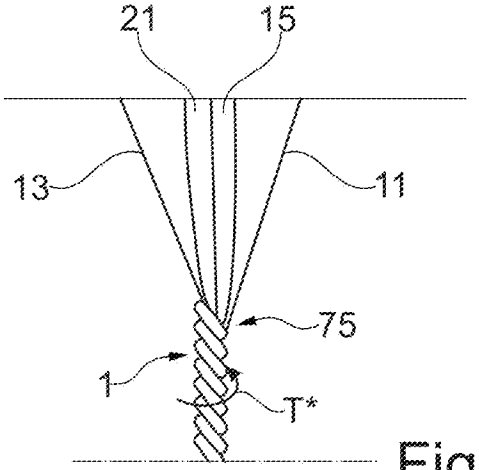
Figure 11:
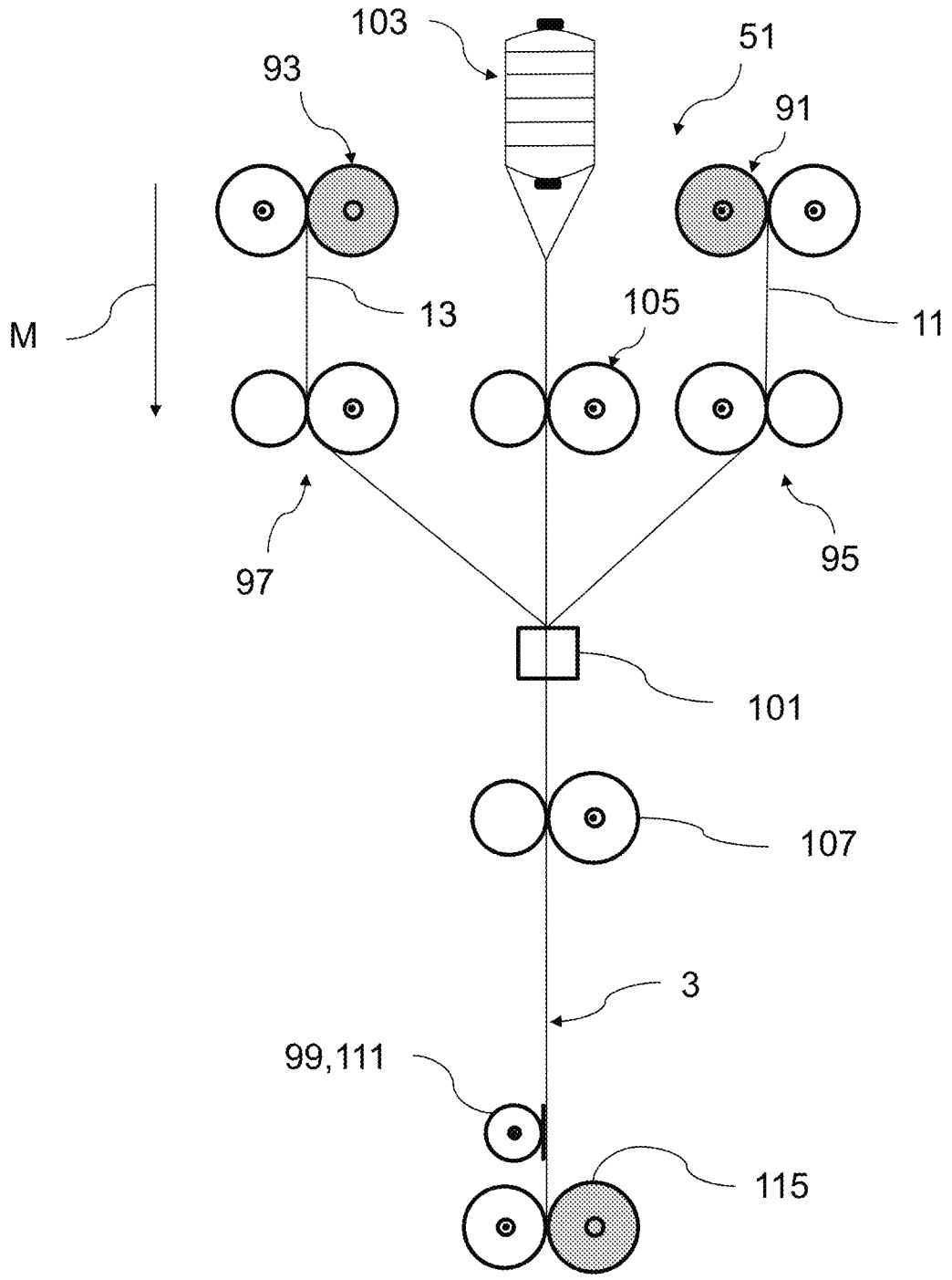
Figure 12:
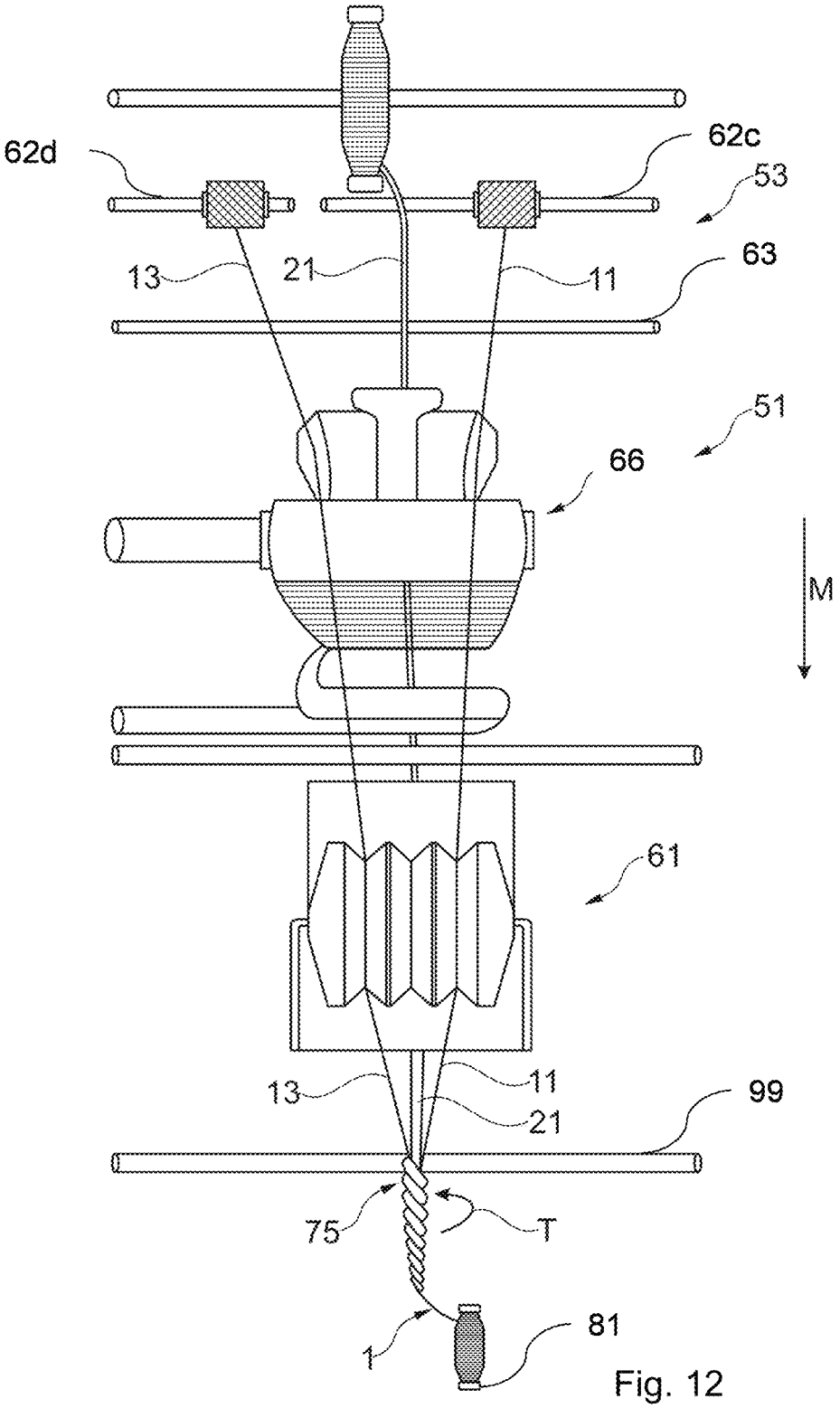
Figure 13:
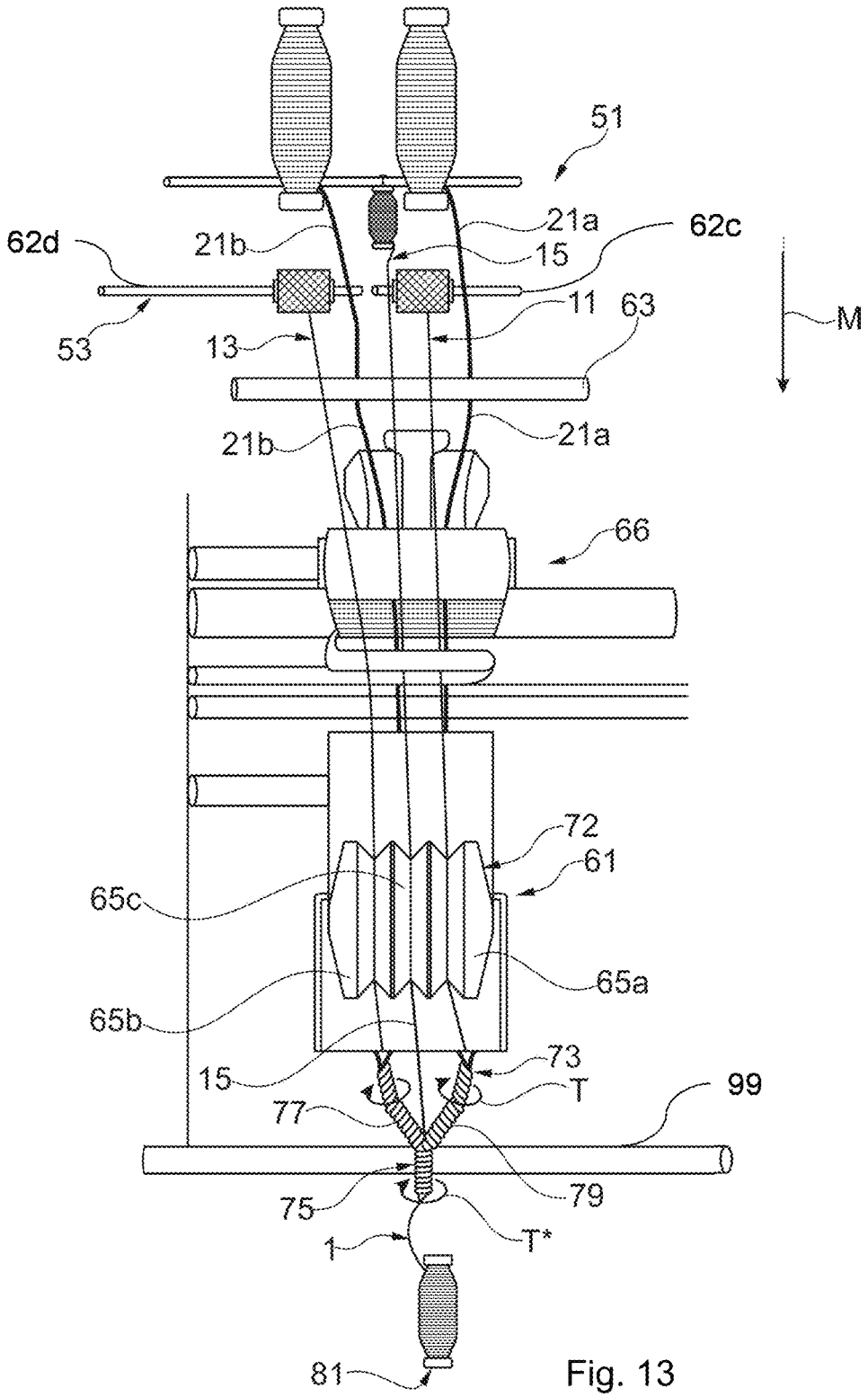
Figure 14:
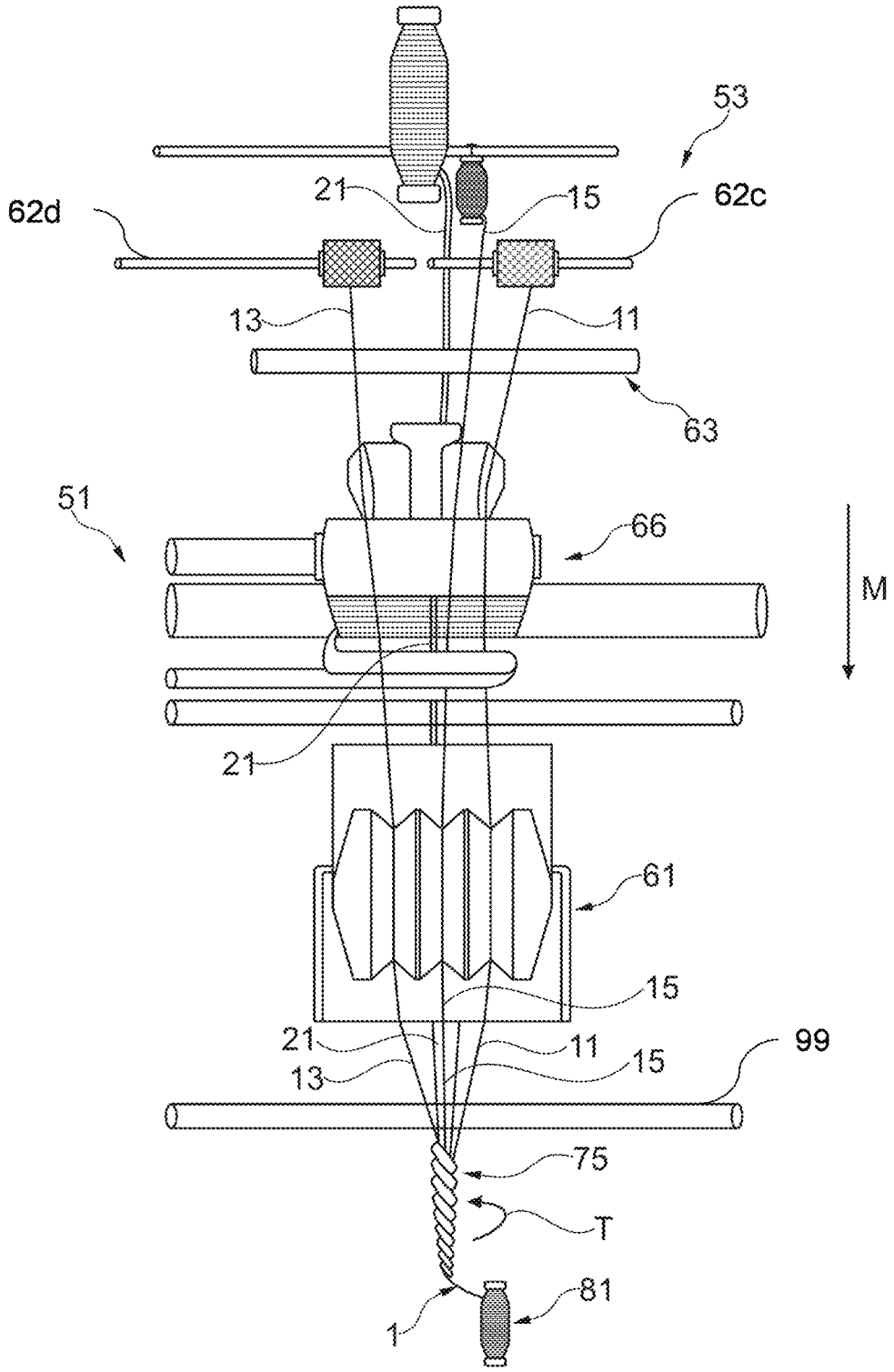
Figure 15:
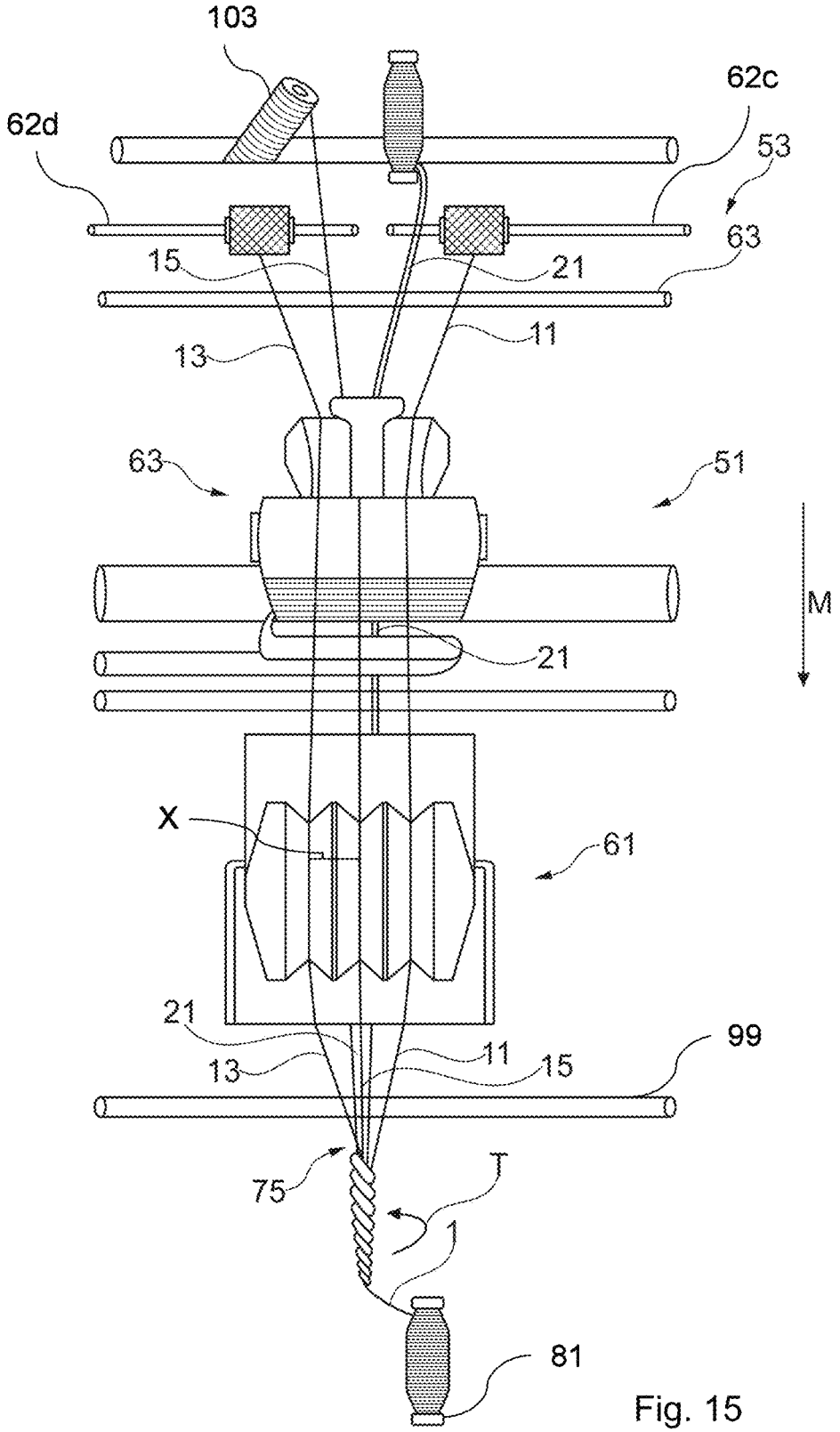
Figure 16:
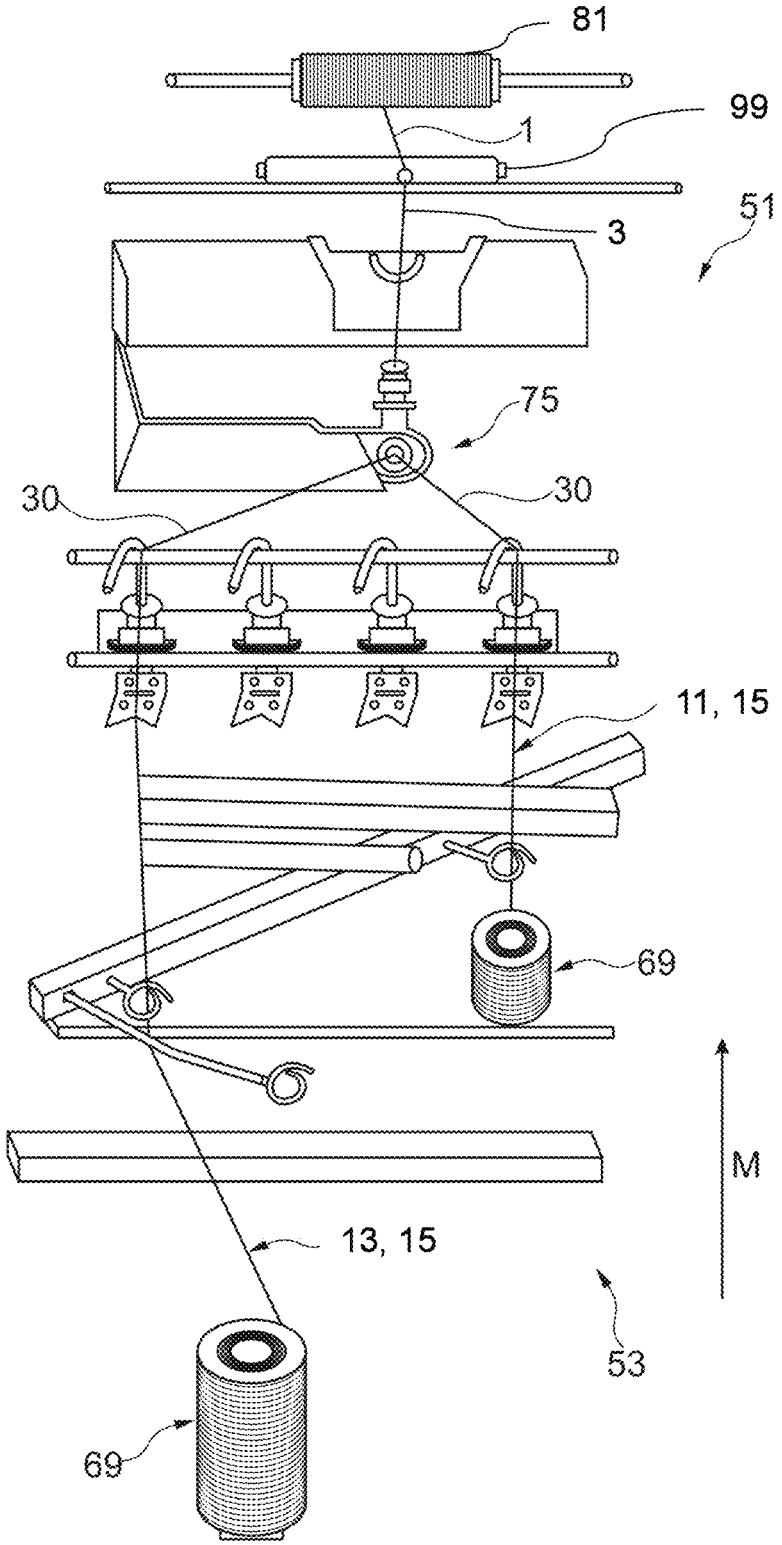
Figure 17:
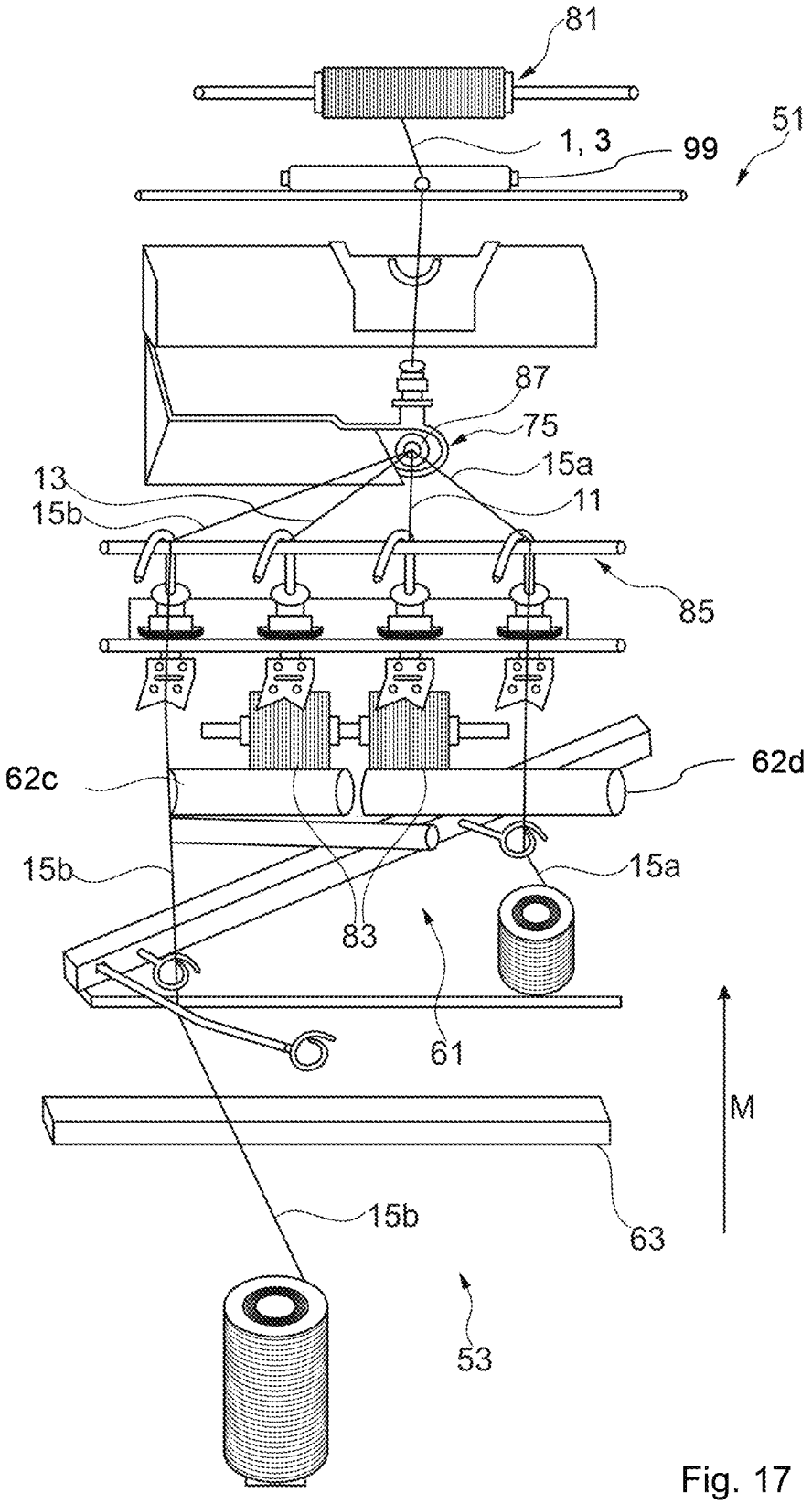
Figure 18:
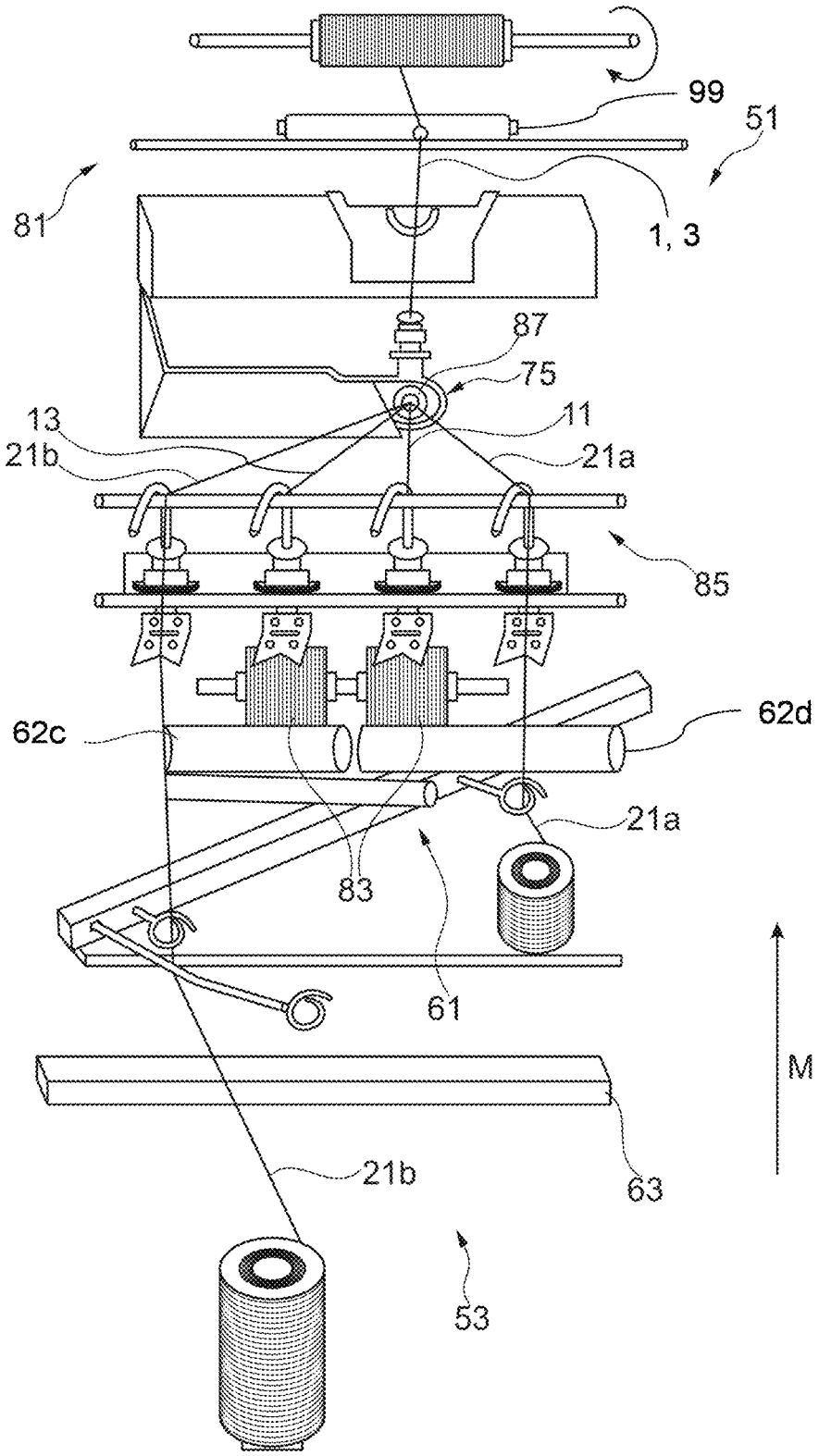
Figure 19:
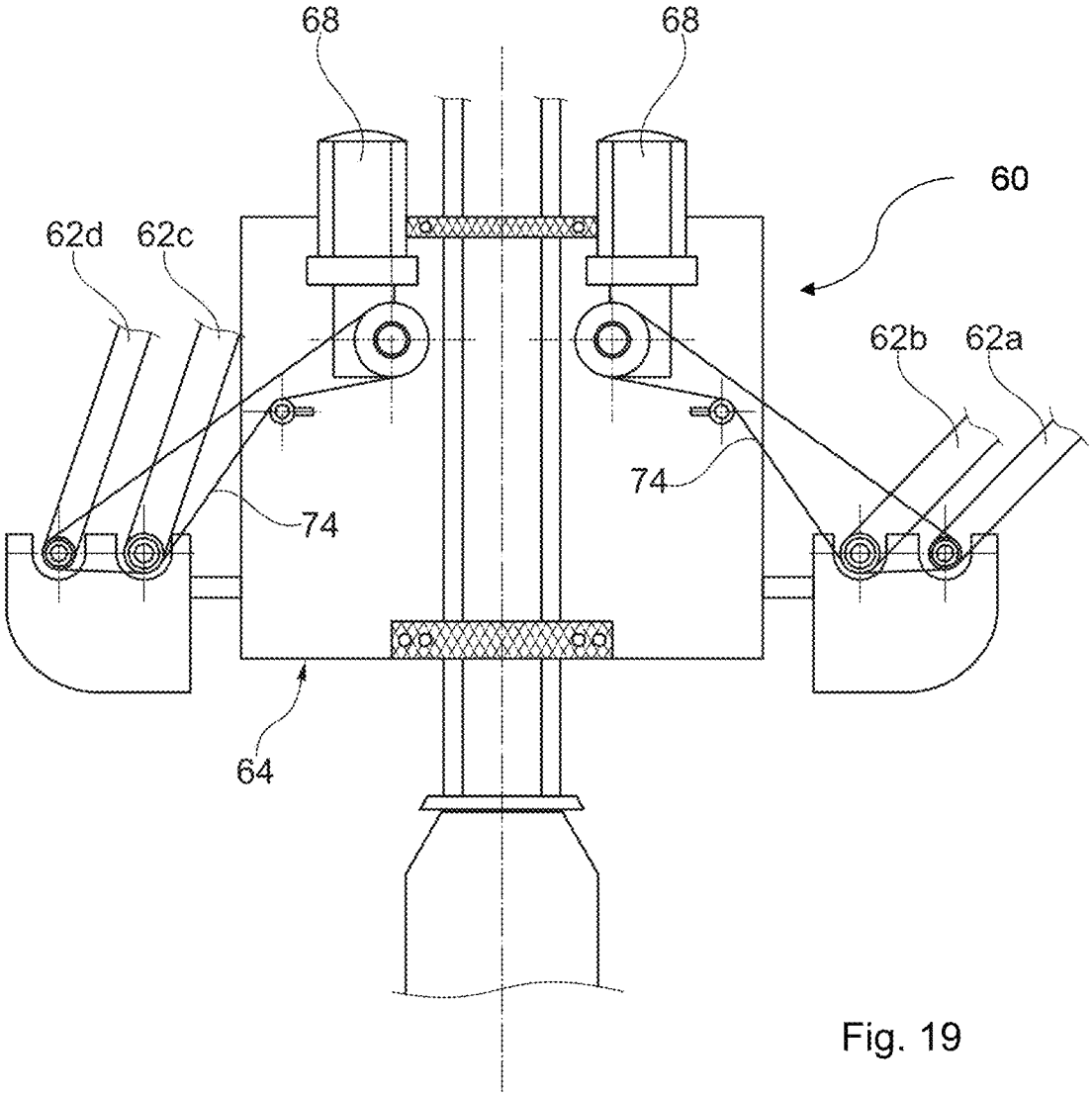
Figure 20:
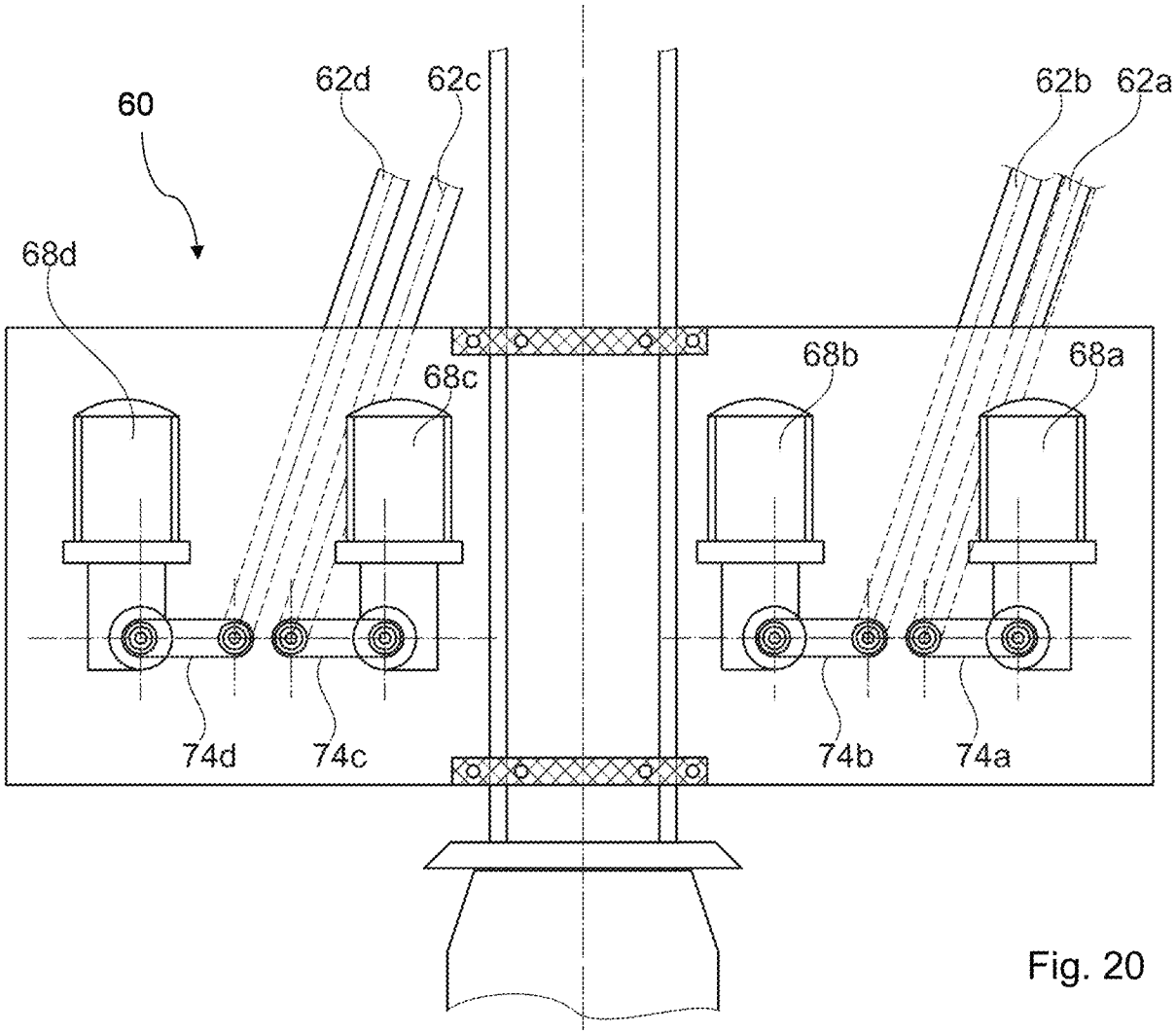
Figure 21:
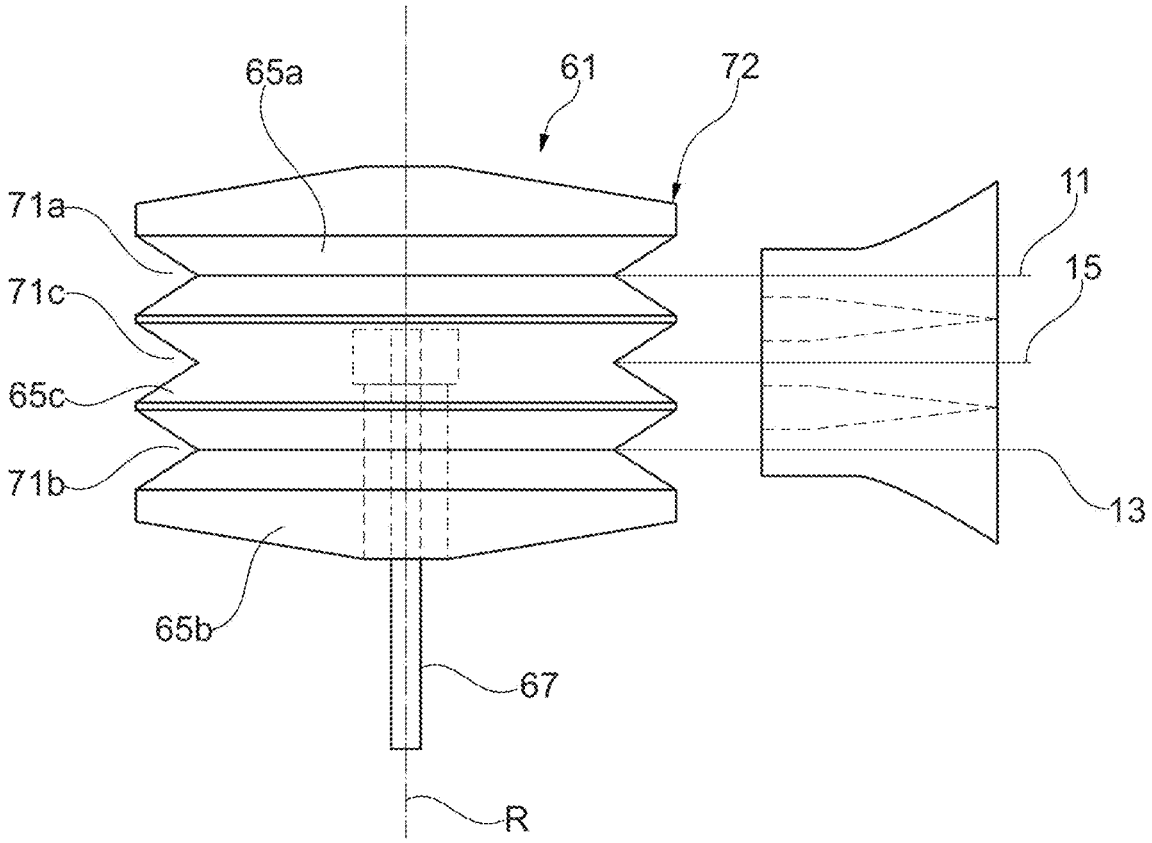
Figure 22:
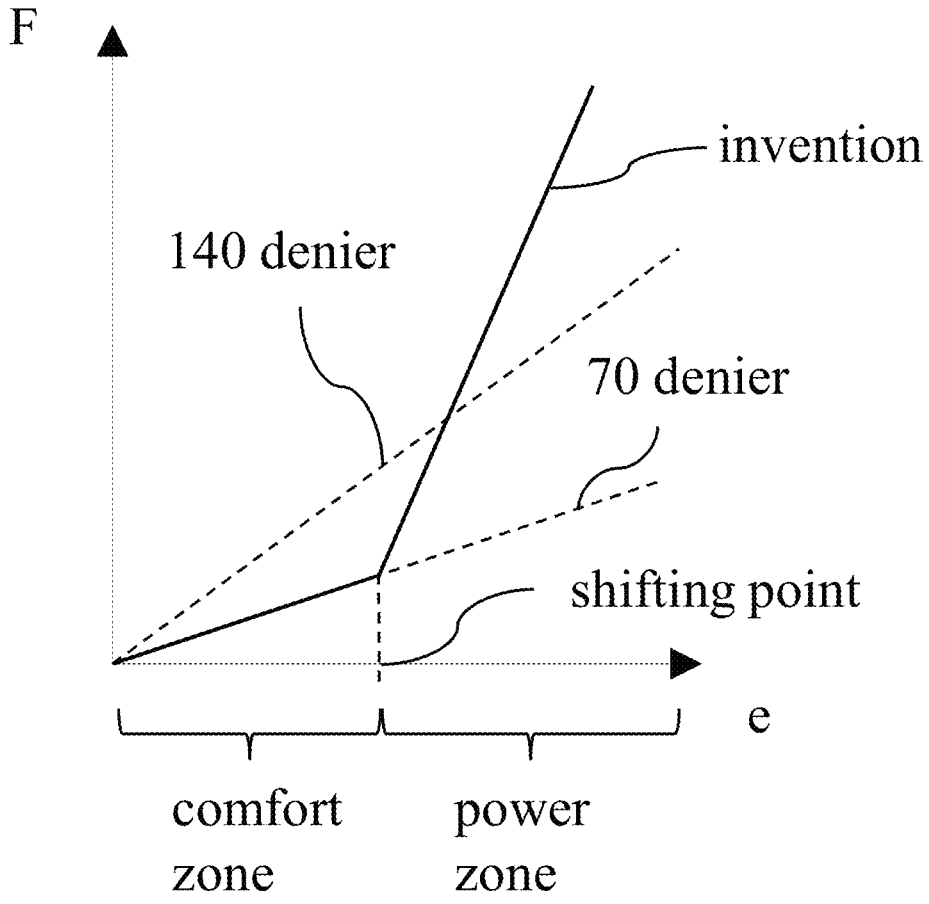

FIG. 7 a schematic side view of a manufacturing process step for making the elastic composite yarn according to the fifth embodiment;

FIG. 8 is a schematic perspective and section view of the elastic composite yarn including a filamentary core according to a sixth exemplary embodiment of the present disclosure;

FIG. 9 is a schematic section view of the elastic composite yarn according to the sixth embodiment;

FIG. 10 is a schematic side view of the manufacturing process step for making the elastic composite yarn according to the sixth embodiment;

FIG. 11 is a schematic side view of a first embodiment of a manufacturing arrangement for making a filamentary core according to a seventh exemplary embodiment of the present disclosure;

FIG. 12 is a schematic front view of a second embodiment of an arrangement for producing an elastic composite yarn according to the first or second embodiments;

FIG. 13 is a schematic front view of an arrangement in a third embodiment for producing the elastic composite yarn according to the third or fourth embodiments;

FIG. 14 is a schematic front view of a fourth embodiment of an arrangement for producing the elastic composite yarn according to the fifth or sixth embodiments;

FIG. 15 is a schematic front view of an arrangement similar to the embodiment of FIG. 14 for producing an elastic composite yarn according to the fifth or sixth embodiments;

FIG. 16 is a perspective schematic front view of an arrangement according to a fifth embodiment for producing an elastic yarn according to an eighth exemplary embodiment of the present disclosure;

FIG. 17 is a perspective schematic front view of an arrangement according to a sixth embodiment of the present disclosure for producing an elastomer composite yarn according to a ninth exemplary embodiment of the present disclosure;

FIG. 18 is a perspective front view of an arrangement according to a seventh embodiment of the present disclosure for producing elastic composite yarn according to a tenth exemplary embodiment of the present disclosure;

FIG. 19 is a schematic detailed side view on a machinery part of above-mentioned arrangements for generating different draft ratios in the at least two elastic performance filaments of the filamentary core;

FIG. 20 is a detailed side view of the machinery part in an alternative embodiment for generating different draft ratios;

FIG. 21 is a front view of a final guiding drum upwards a merging station unifying the filaments/rovings for establishing the filamentary core and eventually the elastic composite yarn;

FIG. 22 is a graph of the behavior of a filamentary core and/or a common elastic composite yarn in comparison with a filamentary core and/or an elastic composite yarn according to an exemplary embodiment of the present disclosure; and FIG. 23 illustrates examples of a filamentary core and/or an elastic composite yarn according to exemplary embodiments of the present disclosure.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

It is an object of the present disclosure to provide a core for particularly an elastic composite yarn overcoming the above-mentioned disadvantages, particularly an elastic yarn to be used for manufacturing a textile material or fabric, for which a growth effect is reduced particularly in case high stress applies, however, particularly within a textile product, preferably the wear comfort being kept particularly constant in areas of the same textile product exposed with lower stress.

The present disclosure refers to a filamentary core for an elastic composite yarn or a stretch yarn or thread. Further, the present disclosure refers to a fabric or a textile manufactured on the basis of the yarn according to the present disclosure by textile manufacturing proceedings like weaving, knitting, crocheting, knotting or even pressing. Particularly, the present disclosure refers to a denim or jeans fabric. Further, the present disclosure refers to an apparatus or a machine and a method for manufacturing the elastic composite yarn.

The filamentary core according to the present disclosure can be produced during the manufacturing process of the elastic composite yarn or can be provided to the yarn production as pre-produced interstage product. The yarn according to the present disclosure suitable for use in the production of textiles shall comprise said filamentary core consisting of at least two elastic performance filaments and eventually a fibrous sheath comprised of fibers surrounding the filamentary core. "Filament" means particularly a sub-strand unit of extreme or indefinite length. Said (mono-) filament appears as a one-piece strand or a molded strand, however, even a filament in the sense of this patent description can be formed by a plurality of sub-fibers (microfibers) which are arranged in order to form said form monofilament. For manufacturing the yarn according to the present disclosure, such filament, particularly even made of a plurality of sub-fibers with indefinite length, can be integrated in the manufacturing process as a single sub-product to be uniformly processed.

According to the present disclosure the filamentary core for an elastic composite yarn, particularly for an elastic textile yarn that preferably should be suitable for use in the production of textiles, particularly as a weft and/or a warp yarn, comprises at least two elastic performance filaments each of the at least two elastic performance filaments being capable of being stretched at least about 2 times its package length and has at least 90% up to 100% elastic recovery after having been released from a stretching 2 times its package length. In order to increase the recovery forces applied by the filamentary core for the elastic yarn the inventor found out that simply increasing the mass/density of a single elastic performance filament used for an elastic composite yarn will indeed increase the recovery forces, however, particularly according to the efficiency of the manufacturing process for making a filamentary core of elastic composite yarns, an elevation of dimension regarding the elastic performance filament is limited. For instance, an elastic performance filament having a mass density of more than 100 Denier cannot easily and efficiently be processed, however, if two separated elastic performance filaments each having a mass/density of less than 50 Denier or 60 Denier, the processing of said two fine elastic performance filaments turned out to be much more effective and simple. Surprisingly, it turned out that using two or more elastic performance filaments not only simply increasing the recovery force by providing 2 times of mass/density regarding each single specific elastic performance filament, rather, because of interaction, as sticking and slipping, between the two elastic performance filaments, the elastic behavior of the filamentary core is strongly improved. Said interaction can be adjusted and adapted according to way of arrangement of the at least two elastic performance filaments. It is of advantage to twist the respective elastic filaments to each other in order to increase the contact surfaces between the at least two elastic performance filaments compared to a loose and more or less parallel arrangement of the at least two elastic performance filaments. Further, the at least two elastic performance filaments, particularly more than 4, 5, 6, 7 or more elastic performance filaments, can be intermingled or joined or in another connecting way. Fixed connection points/areas could be provided in order to avoid slippage of the at least two elastic performance filaments at the connection point. These connection points can be realized by particularly heat molding. By this kind of connecting method, it is possible to provide different elastic performances along one and the same elastic yarn or within one filamentary core, e.g. the draft ratio of the filamentary core or yarn in a first axial portion is larger than the draft ratio of a subsequent portion of the filamentary core or yarn. The connecting points are able to keep the elastic performance within a specific axial portion of the filamentary core or the elastic yarn.

In a preferred embodiment of the present disclosure, wherein the at least two elastic performance filaments are twisted and/or intermingled such that a preferably continuous, particularly helical friction contact between the at least two elastic performance filaments is provided and/or at least partly, additional friction increasing elements, like fabric fibers, as cotton fibers, are hold, particularly clamped, due to the at least two twisted and/or elastic performance filaments in between the filaments, and/or wherein the at least two elastic performance filaments are connected to a further inelastic filament, like a nylon filament or the like, wherein particularly the interconnection is realized in that a first of the at least two elastic filaments is twisted and/or intermingled with the inelastic filament preferably according to a first manufacturing step and the twisted and/or intermingled pair of inelastic filament and the elastic performance filaments is connected to a second elastic performance filament by twisting and/or intermingling, wherein particularly additional friction increasing elements, as fabric fibers, for example cotton fibers, are hold and/or clamped in-between the respective filaments. This specific interconnection of the at least two elastic performance filaments and eventually the at least one further inelastic filament solves the problem of a slippage of a single elastic performance filament, for example a Lycra®-filament. When high elastic stretch garments are worn during the daily body movement, some parts of the garments stretch more than other parts. Particularly, on the backside of the garment, these portions are stretched more due to sitting down and stand up. When the fabric is not very tight and dense due to high stretching movements the elastic performance filament which is preferably inside a weft yarn shall stretch and bounce back. If there is not enough friction a holding of the elastic performance filament particularly at a seam area, the elastic performance filament might slip from inside of the yarn and from stitches of said seam. The elastic performance filament is not anymore connected to said stitches, which causes to harm the desired bounce back effect of the yarn and the fabric looks loose at those high stretched areas of the garment. However, by the preferred interconnection of the at least two elastic performance filaments twisted to each other it was found out that the friction between the two elastic performance filaments is very much increased so that negative slippage particularly in the area of stitches is avoided.

The twisting and/or pre-intermingling of the two elastic performance filaments avoids slippage of the one elastic performance filament within the yarn. Using such a two-set of elastic performance filaments, particularly a two-set of elasthane or two separate Lycra, twisted to each other and being manufactured together with fabric fibers, as cotton fibers, has the effect of holding more cotton fibers due to the separate twisting of the elastic performance filaments around each other. Further, if a set of an inelastic and elastic performance filaments is used, the slippage of the elastic performance filament is weakened particularly in stitching areas. Preferably, the twisting and intermingling is realized by introducing and particularly the twisting at the same time the fiber materials, particularly the fabric fibers, as cotton fibers, so that in between the at least two elastic filaments and/or the inelastic and one elastic filament and/or the two elastic performance filaments and the inelastic filaments the fiber elements are introduced and clamped that work as friction increasing elements. By the preferably continuous, particularly helical friction contact of the at least two elastic performance filaments and eventually the at least one inelastic filament a safety mechanism is put in place in that, in case one of the elastic performance filaments is mechanically destroyed or violated, the other one of the at least two elastic performance filaments cause to keep the elastic performance of the elastic composite yarn and the fabric made thereof. The remaining elastic performance filament and eventually the inelastic filament compensate the defect one. This safety aspect improves the fabric production as well as garment washing and garment drying.

Having two elastic performance filaments and an inelastic filament, according to the above-mentioned providing steps, it is possible to avoid a pre-covering of already intermingled filaments, which reduces the costs. The spinning of the two inelastic performance filaments and eventually the inelastic filament helps to reduce the manufacturing costs for achieving the desired filamentary core and/or elastic composite yarn.

Said filamentary core according to the present disclosure comprises or even exclusively consists of the at least two elastic performance filaments which according to a preferred embodiment could be identically manufactured or structured, particularly with respect to their dimensions (e.g. cross-section) material. The at least two elastic performance filaments because of their manufacturing process may be fibroid strand, however, having an extreme or indefinite length according to the nature of their production. The at least two elastic performance filaments may be separately manufactured and separately delivered in order to form the filamentary core. The filamentary core can be made separately or simultaneously to the manufacturing process for elastic performance filaments. The filamentary core can be made simultaneously with respect to the manufacturing process of the elastic composite yarn or in a pre-stage in order to produce an interstage product which in a second manufacturing phase is introduced into the manufacturing process for the elastic composite yarn. The two elastic performance filaments can be provided each on a mandrel or a spindle, however, even a prepared filamentary core can be provided on an own mandrel or spindle.

Typical examples for an elastic performance filament are a polyurethanic fiber such as elastane, spandex and those filaments that have similar elastic properties. In general, an elastic performance filament according to the present disclosure particularly may be stretched at least 300% or 400% of the package length (e.g. as elongation at break). Package length shall be understood as the initial or original length of the elastic performance filament while essentially no tensile tension is applied. Examples of elastic performance filaments used according to the present disclosure include but are not limited to, Dowxla, Dorlastan (Bayer, Germany), Lycra (Invista, USA), Clerrspan (Globe Mfg. Co., USA), Glospan (Globe Mfg. Co., USA), Spandaven (Gomelast Calif. Venezuela), Rocia (Asahi Chemical Ind., Japan), Fujibo Spandex (Fuji Spinning, Japan), Kanebo LooBell 15

(Kanebo Ltd., Japan), Spantel (Kuraray, Japan), Mobilon (Nisshinbo Industries), Opelon (Toray-DuPont Co. Ltd.), Espa (Toyoba Co.), Acelan (Teakwang Industries), Texlon (Tongkook Synthetic), Toplon (Hyosung), Yantai (Yantei Spandex), Linel, Linetex (Fillatice SpA). In general, these elastic performance filaments provide as a basis of the yarn sufficient elastic properties. It is noted that also elastic performance filaments made of polyolefin could be used. Besides, a preferred elastic performance filament, according to its (own) manufacturing process, may be formed of multiple elastic monofilaments which are coalesced by one another so as to form a single or mono elastic performance filament. The single elastic performance filament according to the present disclosure, after its manufacturing step, is to be used as an interstage product, i.e. its own manufacturing process was finalized, however, each single elastic performance filament particularly provided on a mandrel or the like, is ready to be used particularly for realizing the filamentary core. For an elastic performance filament spandex or elastane can be used, as for instance Lycra® made by Invista. If a Lycra® filament is used, 20 to 100 Deniers, particularly 40 to 140 or 200 Deniers, is suitable. An elastic composite yarn according to the present disclosure may comprise a fibrous sheath consisting of staples or fibers, particularly spun fibers, having a short length. For a denim fabric, cotton fibers are used. Suitable fibers for the sheath are fibers such as cotton, wool, polyester, rayon nylon and similar. Preferably, cotton staple fibers are used to provide a natural appearance and a natural sensation to the elastic yarn. The sheath surrounding the filamentary core shall advantageously completely cover the filamentary core. Any suitable manufacturing process can be used in order to realize the surrounding of the filamentary core with the fibers. A preferred process is spinning, particularly ring-spinning Spinning the fibers is a manufacturing process of forming the elastic composite yarn having the filamentary core, by combining drafting and twisting a strand of staple fibers. It shall be noted that also core-spinning can be used in order to combine the filamentary core with the sheath of fibers.

The elastic composite yarn can be realized by a "naked" filamentary core (without a fibrous sheath) only consisting of at least two elastic performance filaments and eventually of at least one inelastic performance filament according to the above and below definition of elasticity and inelasticity. However, each elastic performance filament could also be provided with an own fibrous sheath which can be generated by means of two separate fiber rovings. The at least two elastic performance filaments and eventually said at least one inelastic control filament can be connected to each other for forming the filamentary core. The connection can be realized with a plurality of connection points as described in WO 2012/062480 A2 which shall be incorporated into this document by reference for indicating, how said filaments can be connected to each other. For instance, the connection can be realized by intermingling or twisting of one of the filaments around the other or others. The connection between said filaments can also be realized continuously along the filamentary core in order to provide a continuous contact surface between adjacent filaments. The more elastic filaments are used, the elastic compartment of the filamentary core can be adjusted using the stick and slip friction effects at the contact surface.

Each of said at least two elastic performance filaments according to the present disclosure shall be capable of stretching at least about two times of its initial length, i.e. package length. After having stressed the at least two elastic performance filaments by stretching at least about two times of its initial length, an elastic recovery of at least 90% up to 100% arises. The elastic recovery is a parameter for the elastic performance of said filaments as mentioned above. The elastic recovery in percent represents a ratio of the length of the elastic performance filament following the release of tension stress with respect to the length of the elastic performance filament prior to be subjected to said tension stress (package length). An elastic recovery having a high percentage, i.e. between 90% and 100%, is to be considered as providing an elastic capability of returning substantially to the initial length after the stress was applied. In this regard, an inelastic (control) filament, as will be mentioned below, is defined by a low percentage elastic recovery, i.e. the inelastic control filament will not be able to return substantially to its initial length, if a stretching of at least two times of its initial length is realized. Said percent elastic recovery of filaments can be tested and measured according to the standard ASTMD3107, the entire content of which is expressively incorporated hereinto by reference. Said test method ASTMD3107 is a testing method for a fabric made from yarns. Of course, it is possible to deviate from the test results of the fabric the elastic recovery for the yarn itself. However, a yarn testing method and testing device can be used for individual measuring filaments and/or yarns. For instance, USTER TENSOR RAPID-3 device (Uster, Switzerland) is able to measure elasticity, breaking force, etc. of yarns or filaments. An example of said testing device is described in WO 2012/062480 A2 which shall be incorporated hereinto by reference.

As mentioned above, the at least two elastic filaments can be realized identically, i.e. by identical structure, material and dimension (cross-section). However, even identical elastic performance filaments can be treated, as heat-treated, so that they provide different elastic performance.

When elongating the filament core, said respective recovery forces applied and generated by said at least two elastic performance filaments differ from each other. By a given tension or elongation submitted to the filamentary core, the one elastic performance filament provides a recovering or bouncing back force which is smaller (or larger) than the bouncing force of the other elastic performance filament. Therefore, according to the present disclosure, the recovery behavior of the filamentary core of the elastic composite yarn and therefore for the fabric made of the elastic composite yarn, can be individually adjusted with respect to the expected stress during use of the yarn/textile. The different behavior regarding the generation of the bouncing force or recovering force by the two elastic performance filaments can be realized diversely, however different realizations being mentioned below by the way of an example.

According to a preferred embodiment of the present disclosure, for a given elongation of the filamentary core, for example an elongation of 1.2, 1.5, 2.0 and/or 2.5 times its package length, said incorporated at least two elastic performance filaments of the filamentary core provide different recovery forces, particularly at each of the above-mentioned given elongations, particularly, for a given elongation area of for instance 1.0 to 2.0 times its package length. Preferably, along the entire elastic elongation of the elastic composite yarn, the at least two elastic performance filaments provide different recovery forces.

According to a further development of the present disclosure, said at least two elastic performance filaments of the filamentary core are structured and/or adapted when being provided for forming the elastic composite yarn, particularly the filamentary core, so as to be provide different elasticity for an equal elastic elongation particularly along essentially 50%, 80% (elastic behavior) or the entire elastic elongation of the elastic composite yarn.

According to a preferred embodiment of the present disclosure, a first elastic performance filament of said filamentary core and a second elastic performance filament of said filamentary core are particularly separately delivered for structuring the filamentary core. It shall be clear that even a third or further separate elastic performance filament can be foreseen within the filamentary core according to the present disclosure.

According to a further development of the present disclosure, the filamentary core can be adapted to provide a non-linear stress-strain behavior. Usually, taking one single elastic performance filament, the stress-strain-behavior of said single filament is essentially linear, particularly when starting the elongation, particularly followed by an essential parabolic course at which the gradient of strain growth continuously rises. The non-linear stress-strain-behavior differs from the above-mentioned linear stress-strain-behavior, in providing a discontinuous growth or progression of the strain-behavior, particularly at a predefined breaking point/range. At said breaking point the stress gradient is discontinued with respect to a continued elongation or strain applied to the filamentary core. Said discontinuation can be identified in a respective strain-stress-diagram according to which at the breaking point/range an inclination of the stress gradient with respect to a continued elongation/strain, abruptly changes/increases. An elongation area below the breaking point, particularly between starting elongation up to the breaking point, establish a comfort zone providing a low recovery force and a low recovery force gradient. For a further elongation above said breaking point a power zone is active providing a high recovery force and a high recovery force gradient.

According to a preferred embodiment of the present disclosure, the filamentary core is provided with a force shifting mechanism for boosting an additional recovery force. The action of providing said additional recovery force is preferably defined at a predetermined shifting point. Said shifting point depends on the rate of elongation of the filamentary core wherein particularly said force shifting mechanism is preset such that, when initiating elongation of the filamentary core, the elastic recovery force applied by the elongated filamentary core is provided by at least one first active performance filament of the at least two elastic performance filaments at this elongation stage. The other second elastic performance filament remains in a passive status according to which said other passive elastic performance filament essentially does not render a recovery force for the filamentary core.

Particularly, said shifting point is set according to a predetermined elongation rate, preferably a predetermined elongation length, of the filamentary core. Upon said shifting point, the passive elastic performance filament is activated in applying its recovery force. From a filamentary-core-point-of-view, an additional recovery force is delivered, added to the recovery force of the already activated first elastic performance filament.

According to a preferred embodiment of the present disclosure, said force shifting point is set at an elongation of the filamentary core of more than 0% or 5% of its package length and less than 100% of its package length, particularly between 10% and 20%, 50% or 60%.

It shall be noted that an initiation of elongation of the filamentary core can be defined in using a specific length of the filamentary core (e.g. 50 cm) and providing a tensile stress onto both ends, as soon as the filamentary core takes up a linear horizontal shape between the two ends where the stress is applied, one can consider the initiation of elongation of the filamentary core.

According to a preferred embodiment of the present disclosure, said first elastic performance filament has a first draft ratio being larger than 1.0, particularly larger than 2.0. Said second elastic performance filament of said filamentary core has a second draft ratio being larger than 1.0, particularly larger than 2.0. The adjustment of a different draft ratio for the at least two elastic performance filaments is a possibility to implement said force shifting mechanism to the filamentary core.

The draft ratio is the ratio between the length of the elastic performance filaments taken from the stock, particularly the package length, to the length of the elastic performance filaments being delivered to the filamentary core, particularly by a spinning device or another stress generating devices, as a draft ratio generator. A draft ratio greater than 1.0 is thus a measure of the reduction in bulk in the weight with respect to the stock elastic performance filament.

According to the first aspect of the present disclosure, the first and second draft ratio differ from each other in at least 0.1 or 0.3, preferably at least 0.5, 0.8 or 1.0 or 1.5. Preferably the at least two elastic performance filaments are identically manufactured or structured.

Said draft ratio difference between the two elastic performance filaments can be adjusted in that the draft ratios are adapted to the expected stresses submitted to the elastic yarn or the textile fabric which shall be manufactured, particularly woven, by means of the elastic composite yarn having said filamentary core, particularly said at least two elastic performance filaments differing in draft ratios. If a high stress condition is expected, the draft ratio differences are larger, if more or less low stress condition is expected, the draft ratio difference can be lower.

According to a preferred embodiment of the present disclosure, a draft ratio difference between the first and the second draft ratio is larger than 0.1; 0.2; 0.3; 0.5, 1.0, 1.5 or 2.0 and/or lower than 1.5 or 2.0, particularly between 0.2 and 2.0 or 0.4 and 1.5.

Regarding to a further embodiment of the present disclosure, a third and eventual further elastic performance filament comprise a third and eventual further draft ratio being equal to one of the first and second draft ratio or differing to the first and second draft ratios in at least 0.1, preferably 0.2, 0.3, 0.5, 0.8 or 1.0, wherein the respective difference between the third and the further draft ratio to the respective other draft ratio is larger than 0.1, 0.2, 0.3, 0.5 or 1.0 and/or lower than 2.0, particularly between 0.1 and 1.0 or 0.3 and 0.8.

Preferably, the first draft ratio is between 1.0 and 2.0, preferably between 1.0 and 1.5, and the second draft ratio is at least 1.5, preferably between 1.5 and 4.0 or 2.0 and 3.5.

In a preferred embodiment of the present disclosure, the at least two elastic performance filaments and preferably the third and eventual further elastic performance filaments have a respective draft ratio particularly being lower than 5.0; 4.5; 4.0; 3.5; 3.0; 2.5; 2.0.

Particularly, for said elastic performance filaments spandex or elastane are used, e.g. Lycra® or Dorlastan® having 40 to 70 Deniers, a draft ratio of 2.5 to 4.0 is considered. If a Lycra® having 110 to 140 Deniers is used, a larger draft ratio of 3.0 to 4.5 is to be considered. The draft ratio for the elastic performance filament can be even larger than 4.5.

According to a preferred embodiment of the present disclosure, at least two elastic performance filaments to be used for forming said filamentary core are differently structured or manufactured in that elastically stretching the at least two elastic performance filaments under unmounted condition (with respect to the fibrous sheath) of at least about 1.2, 1.5, 2.0 and/or 3.0 times their package length, respective recovery forces of the at least two elastic performance filaments differ from each other. The first recovery force rendered by the first elastic performance filament is at least 5%, at least 10% or at least 20% larger than the second recovery force rendered by the second elastic performance filament.

Preferably, at least two elastic performance filaments to be used for forming said filamentary core comprise different thicknesses, said thickness difference being larger than 2.5, 5.0 or 10.0 Denier, particularly the thickness of the at least two elastic performance elements is chosen from 20, 40, 70, 105, 140 Denier. It shall be clear that the different elastic performance of the at least two elastic filaments can either be realized by the choice of different thicknesses for the elastic performance filaments and/or of applying different draft ratios. Of course, it is preferred that using the same sized elastic performance filaments can be applied with two different draft ratios in order to make them reacting differently when elastically stressed.

According to a preferred embodiment of the present disclosure, the filamentary core further comprises at least one inelastic control filament, the at least one inelastic control filament being not capable of being stretched beyond a maximum length without permanent deformation, said maximum length being less than 1.5 times of its package length. Typical material for the inelastic control filament or a respective example for such a filament are: T400, PBT, polyester, nylon, etc.

According to a first aspect of the present disclosure an elastic composite yarn shall include or exclusively consist of said filamentary core. The elastic composite yarn may comprise a sheath surrounding said filamentary core. The elastic composite yarn is suitable for use in the production of textiles. Particularly, the elastic composite yarn is to be used for the production of a jean or a denim fabric being for example a cotton warp-faced twill textile, in which particularly the weft passes under two or more warp threads. The elastic composite yarn according to the present disclosure can be used for the weft threads and/or warp threads. Preferably, within the entire denim fabric, the same elastic composite yarn according to the present disclosure is used.

The present disclosure shall also refer to a fabric, particularly a denim fabric, being manufactured on the basis of elastic composite yarns according to the present disclosure. A further aspect of the present disclosure refers to a fabric, like a denim fabric or jean fabric, being manufactured by using the elastic composite yarn as mentioned above.

According to a further aspect of the present disclosure, it shall refer to a manufacturing method for making the filamentary core or the elastic composite yarn particularly as mentioned above. It is noted that all of the manufacturing process related aspects of the above description of the elastic composite yarn of the present disclosure shall be part of the manufacturing method according to the present disclosure.

The method for producing the filamentary core and/or elastic composite yarn comprises: providing separately at least two elastic performance filaments being capable of being stretched at least 2-times its package length and has at least 90% up to 100% elastic recovery after having been released from a stretching 2-times its package length. Further, the method comprises the step of eventually providing or introducing at least one inelastic control filament being not capable of being stretched beyond a maximum length without permanent deformation said maximum length being less than 1.5 times of its package length. Further, the method preferably comprises a step of arranging, particularly spinning, a fibrous sheath around said filamentary core, particularly around said at least two elastic performance filaments and eventually said at least one inelastic control filament. Particularly, before the step of arranging, e.g. spinning, said filamentary core or said at least two elastic performance filaments are structured or adapted in such that, when elongating the final elastic composite yarn, said at least two elastic performance filaments apply different elastic recovery forces.

According to a preferred embodiment of the method according to the present disclosure, the step of adapting or structuring comprises providing said at least two elastic performance filaments with different moduli of elasticity (Young's Modulus) for a common elastic elongation particularly along essentially 30%, 50%, 80% or the entire elastic elongation of said at least two elastic performance filaments.

According to a further development of the method according to the present disclosure, the step of adapting or structuring comprises generating a first draft ratio for a first elastic performance filament and a second draft ratio for a second elastic performance filament, the first and second draft ratios differing from each other in at least 0.1, preferably at least 0.2, 0.3, 0.5, 0.8 or 1.0, wherein particularly said at least two elastic performance filaments being identically structured.

It shall be clear that the different elastic behavior of the two elastic performance filaments can also be realized by combining the steps of providing different draft ratios and providing different moduli of elasticity and/or providing different thickness for the respective elastic performance filaments.

According to a preferred embodiment of the present disclosure, the method further may comprise providing one or at least two separate rovings of fibers, as cotton fibers or the like, particularly for making said fibrous sheath. One of these two separate rovings can be used for spinning a fibrous sub-sheath around each elastic performance filament before merging the at least two embedded elastic performance filaments and eventually said at least one inelastic control filament particularly to form a filamentary core and simultaneously form the overall fibrous sheath or coat surrounding said filamentary core. Preferably, the eventually added at least one inelastic control filament will not be pre-covered by a spinning of fibrous sub-sheath, rather, the merging is realized by the two elastic performance filaments surrounded by a fibrous sub-sheath and by a "naked" at least one inelastic control filament. By the filaments enrobed by an own fibrous sheath, an elastic composite yarn can be realized in which the filaments have friction increasing elements by means of the fabric fibers, as cotton fibers, in order to avoid slippage of the elastic performance filament.

According to an alternative method for manufacturing the elastic composite yarn according to the present disclosure, the filamentary core as such can be realized first or simultaneously when spinning fibers for forming the fibrous sheath.

However, in a preferred embodiment, the fibrous sheath is realized by spinning fibers around the at least one inelastic control filament. The at least two elastic performance filaments are added to the inelastic control filament already surrounded by the fibrous sheath in order to finalize the elastic composite yarn. It shall be clear that the elastic performance filaments are integrated into the inelastic filament/fibrous sheath/arrangement with different draft ratios and/or different thickness and/or different elastic materials, in order to provide the different elastic behavior for the at least two elastic performance filaments.

According to a further independent aspect of the present disclosure, an arrangement for producing an elastic composite yarn is provided, which can be realized according to the above-mentioned elastic composite yarn according to the present disclosure. It is noted that the arrangement according to the present disclosure can be defined such that it realizes the method for producing the elastic composite yarn according to the present disclosure and vice versa.

The arrangement according to the present disclosure comprises at least two separate supplies for separately supplying at least two elastic performance filaments, optionally one or at least two separate roving supplies for separately supplying at least two separate rovings of fibers, like cotton fibers, for making a fibrous sheath. Each roving can be used for preparing a filament-individual fibrous sub-sheath. Further, the arrangement optionally can comprise at least one further supply for separately supplying one inelastic control filament. Preferably for each separate roving an elastic performance filament is foreseen particularly in the center of the two fiber rovings, wherein particularly the two fiber rovings including the respective elastic performance filament are spun together particularly after the two separate rovings and the respective elastic performance filament is combined, in order to create a helical filament-structure.

Besides, the arrangement according to the present disclosure comprises one draft ratio generator for each of the at least two elastic performance filaments so that at least two draft ratio generators being adjusted or adjustable for introducing at least two elastic performance filaments for the elastic composite yarn as a final product at different draft ratios particularly differing from each other at least 0.1, 0.2, 0.3, 0.5, 0.8 or 1.0.

According to a preferred embodiment, a spinning station, particularly a ring-spinning station and/or a filament merging station is arranged downstream of the draft ratio generators, regarding the filament supplying direction. Said spinning station may be positioned downstream subsequent the draft ratio generators and upstream the filament merging station followed by a final yarn package. Particularly, the spinning station is associated only to the at least two elastic performance filament to cover them with a fibrous sub-sheath. The eventual inelastic control filament passes by the spinning station without receiving fibers, rather remaining naked, until to be merged into the elastic composite yarn.

Alternatively, the spinning station can be positioned upstream the merging station in that the fibers of the at least one roving of fibers is spun around the inelastic control filament, in the case an inelastic control filament is foreseen. Downstream this spinning action, the merging station is realized, at which location the at least two elastic performance filaments are integrated into the fibrous sheath both filaments having already a different draft ratio.

During the merging station or downstream the merging station, the at least two elastic performance filaments and eventually the at least one inelastic control filament are connected to each other by for instance intermingling or twisting.

Figure 1B:
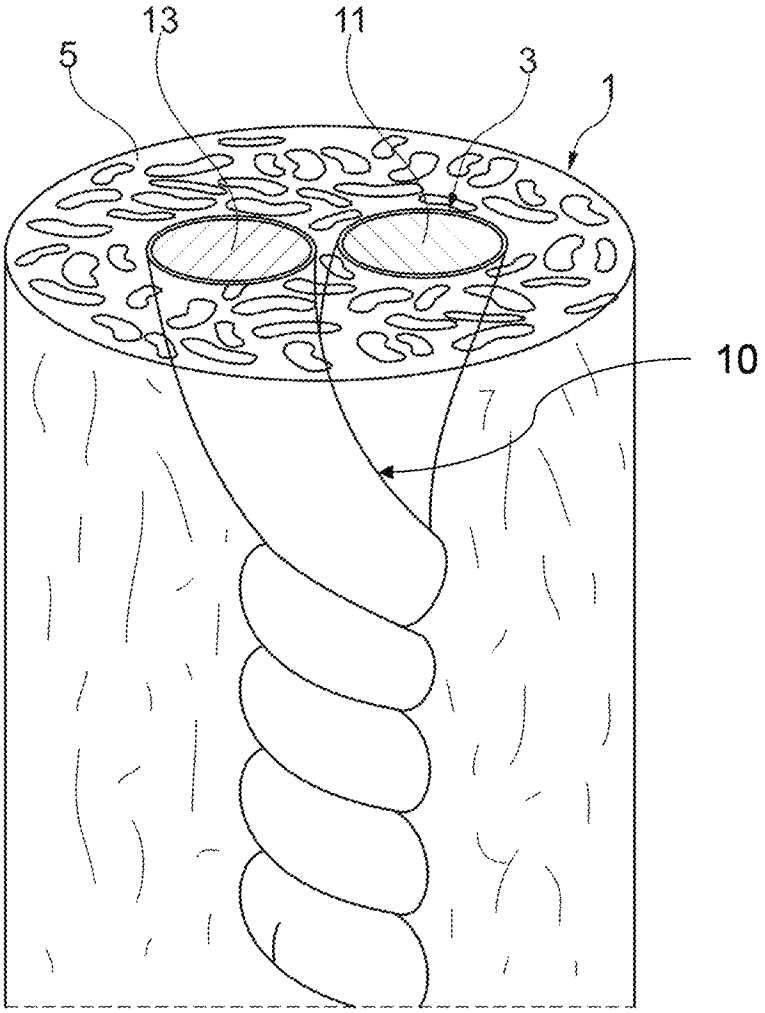
Figure 1A:
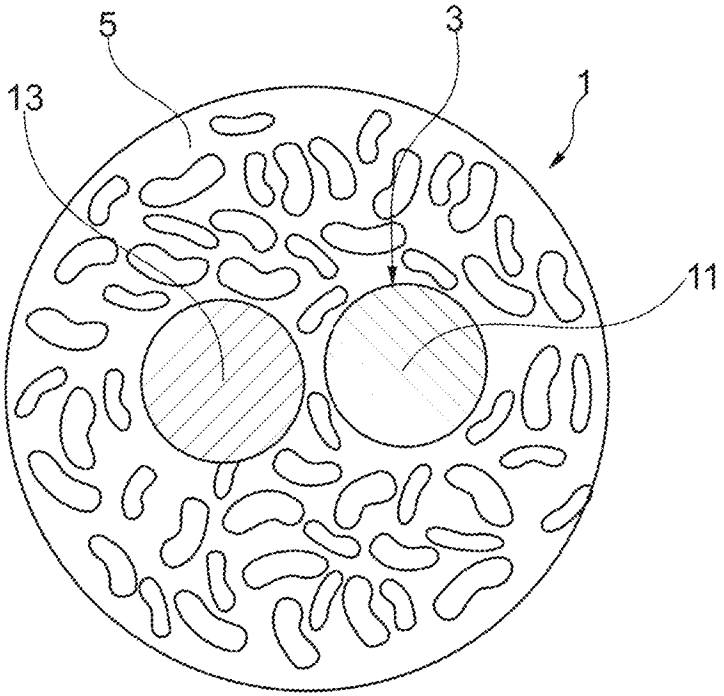

In FIGS. 1*a* and 1*b* an inventive elastic composite yarn 1 including a filamentary core 3 according to a first, basic embodiment of the present disclosure is shown. Said elastic composite yarn 1 consists of a second main component, namely beside said filamentary core 3, a fibrous cotton sheath 5 surrounding completely the filamentary core 3 so that the last is completely covered and embedded by the cotton staple fibers of sheath 5.

The filamentary core 3 of yarn 1 according to this first embodiment consists exclusively of two elastic performance filaments 11, 13. Each elastic performance filament 11, 13 is an elastane filament, e.g. made of multi-strands, i.e. a plurality of microstrands come together in order to make the unique elastic performance filament 11, 13 made in a separated ex-ante manufacturing process. A preferred elastic performance filament can be used by means of Lycra® from the company Invista and/or Dorlastan® from Bayer AG. Such elastic performance filaments 11, 13, as elastane, can be stretched 4 to 6 times longer than their original package length.

By two elastic performance filaments 11, 13, of course, at least the elastic performance of the filamentary core 3 is doubled with respect to a single elastic performance filament 11, however, as, according to the subject-matter of the present disclosure, the at least two separate elastic performance filaments 11, 13 are arranged for establishing contact and connecting surface(s) 10 between the at least two elastic performance filaments 11, 13 which improves the performance of the filamentary core 3 in an unexpected manner. Said contact surfaces 10 can be generated by twisting the at least two elastic performance filaments 11, 13. Other interconnecting measures, like intermingling, etc. can be considered. Because of the high elasticity of the elastic performance filaments 11, 13, at the contact surfaces 10 different friction scenarios, as a stick-slip-effect occur, which on the one hand side supports in protecting the elastic performance of the respective filaments 11, 13 and on the other hand, improves the recoverability of the respective filaments 11, 13 and the entire filamentary core 3.

It turned out that for the manufacturing process for making the filamentary core 3 having at least two elastic performance filaments 11, 13 instead of a larger single elastic performance filament having the same mass/Denier as the total sum of mass/Denier of the combined filaments 11, 13, the process speed can be increased without deteriorating the quality of the filamentary core 3 and therefore the elastic composite yarn 1.

Each of the elastic performance filaments 11, 13 may have a thickness of 20 Denier to 140 Denier or 200 Denier, preferably below 90 Denier or 100 Denier. However, the filamentary core 3 in total can establish a mass/density of more than 30 Denier, up to more than 100 Denier or 120 Denier or even more than 150 Denier or 200 Denier.

Further, it shall be clear, that in order to provide different elasticity for the two elastic performance filaments 11, 13, different elastic materials, different draft ratios and/or different thicknesses, etc. for the elastic performance filaments 11, 13 can be considered. The contact surface(s) 10 supports in keeping different draft ratios in the elastic performance filaments 11, 13 so that the elastic performance of the filamentary core is essentially stable along its entire storage length.

In this preferred embodiment of FIGS. 1*a* and 1*b*, the filamentary core 3 consists of two identically structured performance filaments 11, 13 formed by the same elastic material with the same elastic modulus.

In order to adjust the elastic compartment of the filamentary core 3, i.e. the elastic composite yarn 1, it is preferred to combine at least two different elastic performance filaments 11, 13 which shall differ in their elastic behavior. The filamentary core 3 therefore provides a non-linear elastic behavior depending on the elongation of the filamentary core, i.e. the elastic composite yarn 1. Particularly, in the case of using the filamentary core 3 for making a textile fabric, it is of advantage to provide a comfort zone in which the recovery forces are low within an initial strain area, for example from 0% to 20% or 50% elongation. However, for a stronger elongation, much higher recovery forces shall be applied (higher according to the linear elastic behavior of a single elastic performance filament) said stronger elongation area being called power zone. In order to make an indifferent elastic behavior for the filamentary core 3 and consequently the entire elastic composite yarn 1, the draft ratio of the respective elastic performance filament 11, 13 can be considered.

The draft ratio of the elastic performance filament 11 can be lower than the draft ratio of the elastic performance filament 13. For instance, the elastic performance filament 11 comprises a draft ratio 2.3 to 2.8, while the elastic performance filament 13 is combined to the elastic performance filament 11 having a larger draft ratio being about 3.8 to 4.3.

By this difference of draft ratio, at a growing tensile stress submitted to the filamentary core 3, first, only or mainly the first elastic performance filament 13 having the larger draft ratio is "switched on or activated first" and applies a stronger re-bouncing force, while the second elastic performance filament 11 having a lower draft ratio still is "switched off" or more or less inactive or less active in providing re-bouncing back forces. However, if strong tensile stress will be applied to yarn 1, besides the activated elastic performance filament 13 the performance filament 11 is "switched on" and because active in adding its re-bouncing force and therefore erratically increasing the recovery force of the filamentary core 3.

Two different draft ratios for the first and second elastic performance filament 11, 13 provides a force shifting function or force shifting mechanism for boosting a further recovery force, namely as soon as the elongation of the filamentary core 3 and therefore the elastic composite yarn 1 passes an elongation shift point. Said elongation shift point is preset by the applied ratio difference to the elastic performance filament 11, 13. Said force shifting mechanism defines a predetermined shifting point depending on the rate of elongation of the filamentary core 3 or the elastic composite yarn 1 and therefore on the draft ratio difference. It shall be clear that other kinds of force shifting mechanisms, as draft ratio difference, can be considered in order to provide the boosting effect of a further increased recovery force.

As seen in FIG. 19, both elastic performance filaments 11, 13 are being warped or twisted in helical or spiral way providing a large friction and connecting surface 10. The filamentary core 3 is arranged more or less in the center of the fibrous sheath 5. A fabric manufactured on the basis of yarn 1, has excellent recovery properties while the above-mentioned "corset" effect is avoided.

Although, in the section view of FIG. 1*a*, a circular outside shape of yarn 1 is visible, however, it shall be clear that yarn 1 can have any kind of circumferential section shape, particularly as the fibrous sheath is a soft arrangement or a fiber accumulation spun around the filamentary core 3.

Figure 2A:
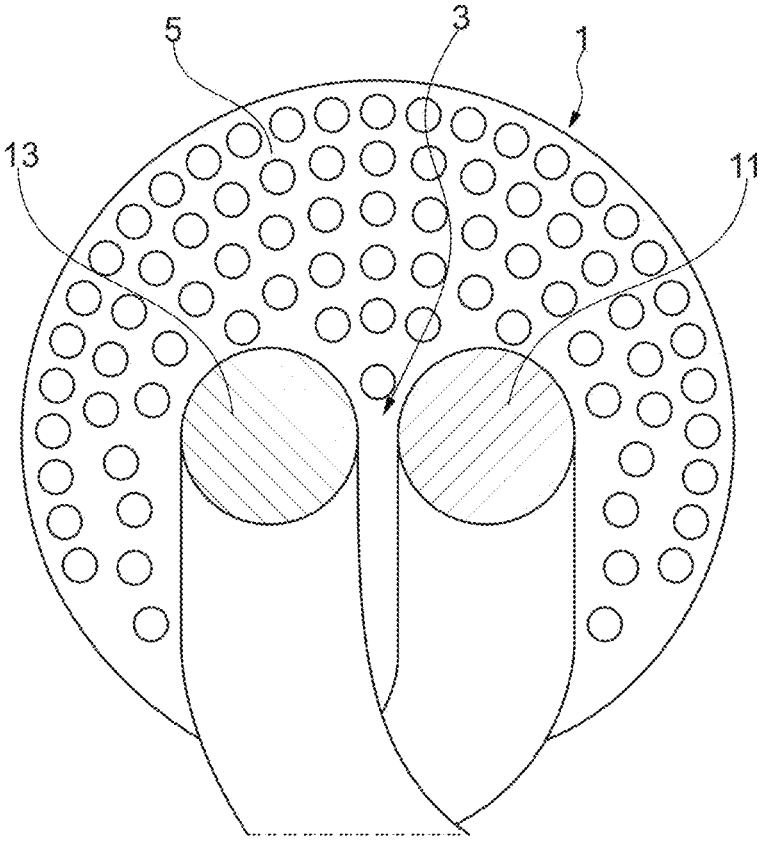
Figure 2B:
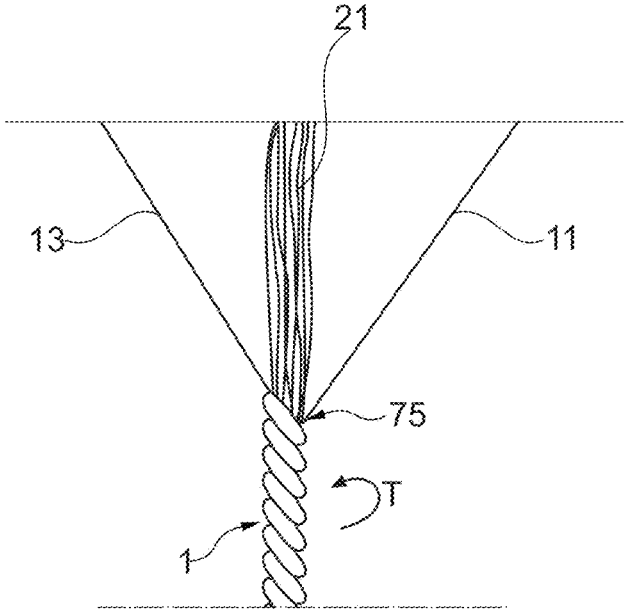

In FIGS. 2*a* and 2*b*, a second embodiment of an elastic composite yarn 1 is shown. For the sake of an easier legibility of the description of figures, same reference signs are used for similar or identical elements of the elastic composite yarn 1 of FIGS. 2*a*, 2*b* compared to the embodiment of FIGS. 1*a* and 1*b*.

The embodiment of FIGS. 2*a* and 2*b* differs from the elastic yarn 1 according to FIGS. 1*a* and 1*b* only in the fibrous sheath 5. The arrangement of fibers or the accumulation of fibers in the fibrous sheath 5 according to FIGS. 2*a* and 2*b* is realized by fibers which are homogenously orientated in the extension direction of the yarn 1. In contrast thereto, the fibrous sheath 5 according to FIGS. 1*a* and 1*b* may be differently orientated. Further, the cross-section of the fibers in the fibrous sheath according to FIGS. 2*a* and 2*b* are essentially circular, while the cross-section of the fibers according to the fibrous sheath in FIGS. 1*a* and 1*b* have a kidney shape.

The manufacturing process step according to FIG. 2*b* shows three strands, the two thin ones represent the elastic performance filaments 11, 13. The broader strand represents a roving 21 made of cotton fibers in order to form the fibrous sheath 5. As can be seen in FIG. 2*b* at a specific position, i.e. a merging position or merging station, the foremost separately delivered two elastic performance filaments 11, 13 are unified together with the cotton roving 21 by twisting resulting in yarn 1, the twisting movement is represented by the curved flash T. A corresponding arrangement on machinery for producing this yarn 1 according to FIGS. 1 and 2 is shown in FIG. 12, which will be explained in more detail below.

It shall be clear, that the elastic composite yarn 1 according to the present disclosure can also be realized without the fibrous sheath 5, rather, being formed by the filamentary core 3 of the present disclosure including for instance only said two elastic performance filaments 11, 13.

However, in a preferred embodiment, for stabilizing the elastic composite yarn 1 only consisting of the filamentary core 3 according to the present disclosure, an inelastic control filament 15 can be combined with the elastic performance filaments 11, 13. There are at least two ways of combining, particularly intermingling or twisting the elastic performance filaments 11, 13 with the one inelastic control filament 15. Either it is realized before bringing the two elastic performance filaments 11, 13 together, or the at least three filaments (two elastics, one inelastic) can be combined together at one single merging position or merging station 75.

In a preferred embodiment of an elastic composite yarn 1 without fibrous sheath, which corresponds to the seventh embodiment of the elastic composite yarn (this elastic composite yarn is not drawn in detail herein, however, the respective machineries with the manufacture steps for making said elastic yarn 1 is illustrated in FIG. 11, 16, 17), the composite yarn 1 only consists of the filamentary core 3. The filamentary core 3 comprises two elastic performance filament 5, 11, 13 and one or two inelastic control filaments 15. The inelastic control filament 15 and two elastic performance filaments 11 or 13 are brought together, particularly intermingled and/or twisted, in a preceding manufacturing process in order to create the filamentary core 3.

According to an embodiment of the present disclosure, the filamentary core 3 consisting of just two pairs of one elastic performance filament 11 or 13 and just one inelastic control filament 15. When the filamentary core 30 is formed, the two elastic performance filaments 11, 13 already comprise different draft ratios. Said different draft ratios can be produced either when merging or before merging.

The elastic composite yarn 1 (FIG. 17) can be produced using four filaments (11, 13, 15*a*, 15*b*), elastic performance filaments 11, 13 and said two inelastic control filaments 15. Thus are merged together at a single merging station 75 which is shown in FIG. 17. In this manufacturing arrangement, the two elastic performance filaments 11, 13 are delivered to the merging station 75 already submitted with different draft ratios.

It shall be clear that the elastic composite yarn 1 in general can comprise one or more pairs of elastic performance filaments 11, 13 and one or more inelastic control filaments 15. However, even a combination of one, two or three more elastic performance filaments 11, 13 with respect to a lower, equal or higher number of inelastic control filaments 15 shall be understood as a specific embodiment of this patent specification.

Figure 3A:
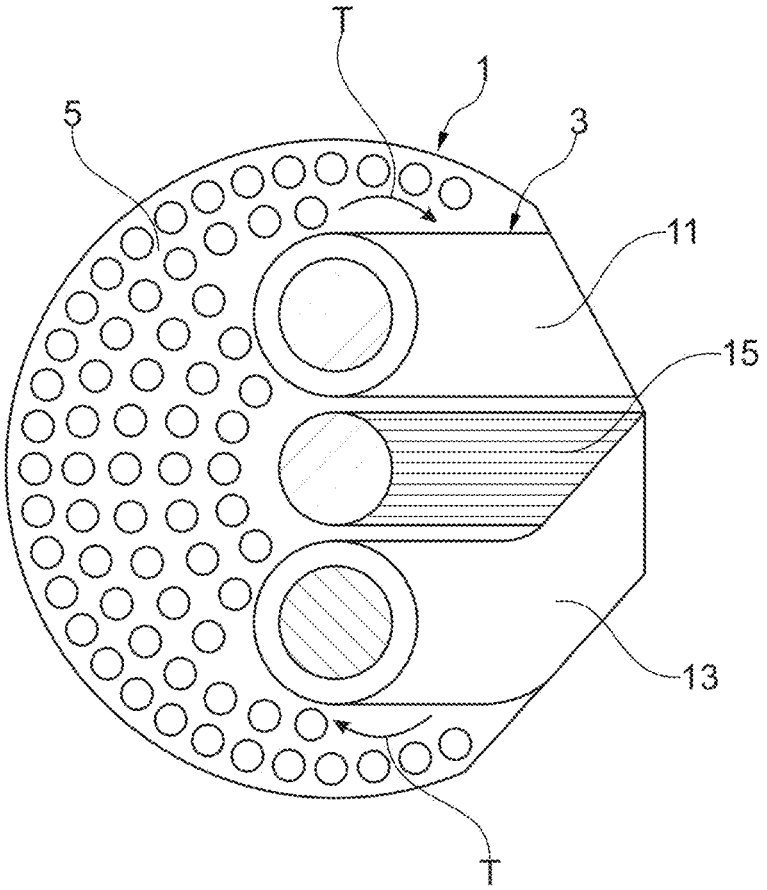
Figure 3B:
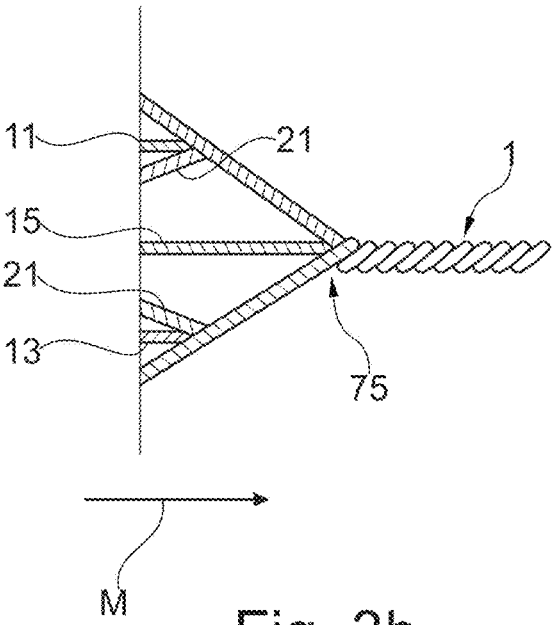

Coming back to an elastic composite yarn 1 having a fibrous sheath 5, it shall now be referred to FIGS. 3*a* and 3*b* showing a third embodiment of an elastic composite yarn 1 including a filamentary core according to the present disclosure. For the sake of an easy legibility of the description of figures, it shall be noted that for similar or equivalent components of the composite yarn 1 the same reference signs shall be used.

The elastic composite yarn 1 according to FIGS. 3*a* and 3*b* differs from the above-mentioned elastic composite yarns according to FIGS. 1 and 2 in that the filamentary core 3 additionally consists of one inelastic control filament 15 around which the two elastic performance filaments 11, 13 are helically or spirally wound or spun, as indicated in FIG. 3*b*. The helical arrangement of the two elastic performance filaments 11, 13 is realized after the respective elastic performance filaments 11, 13 are covered by a fibrous material 21, i.e. the merging position 75 and the spinning action of the fibers around the elastic performance filament 11, 13 are offset from each other regarding the conveying direction M of the manufacturing process. The spinning action of the fibers around the elastic performance filaments 11, 13 as well as the draft ratio generator are positioned upwardly the merging station 75.

The filamentary core 3 consists exclusively of one inelastic control filament 15 and the at least two elastic performance filaments 11, 13. The one inelastic control filament 15 is centered and protected by the two elastic performance filaments 11, 13. The fibrous sheath represents a soft protecting cover of the filamentary core 3.

An inelastic control filament 15 can be realized by short multiple strands for forming a long monofilament, as shown in FIG. 3*a*, 3*b*, 11, 13, 14, 15, 16, 17. The inelastic control filament 15 may be any inelastic filament known to the skilled person. The filament is to be considered as inelastic if it cannot be stretched beyond a maximum length without permanent deformation said maximum length being less than 1.5 times of its original package length. Suitable inelastic control filaments 15 include filaments formed of any fibrous polymer such as polyamide, particularly nylon 6, nylon 66, PBT and the like. Further, also polyesters, polyolefins (e.g. polypropylene, polyethylene) and the like as well as mixtures and copolymers of the same can be used. For the inelastic control filament 15, polyester, nylon or any other synthetic with the above-mentioned definition of elasticity can be used. For instance, an elastomultiester or an elastomerel, as T400®, being a bicomponent elastic polyester can be used. T400® is produced by Invista for which two different polyesters can be extruded together.

The at least two performance filaments 11, 13 and the at least one inelastic control filament 15 can be connected at a plurality of connection points. The connection can be realized by intermingling or twisting. Regarding the connection or regarding the connection of filaments (11, 13, 15) in general the content of WO 2012/062480 A2 shall be considered as being included into the disclosure of this patent specification.

According to the present disclosure, the filamentary core 3 comprises a non-linear different elastic behavior depending on the expected stress and strain applied to the elastic composite yarn 1.

Such an adjusted recovery behavior can be generated by applying different draft ratios for the two elastic performance filaments 11, 13. The first elastic performance filaments 11 comprise a first draft ratio being smaller than a second draft ratio of the second elastic performance filament 13. Therefore, in a stress situation of applying small elongations on the elastic composite yarn 1, in a first place the second elastic performance filament 13 is (more) active in providing higher recovery forces than the first (maybe even inactive) elastic performance filament 11. This is because of the higher draft ratio in the elastic performance filament 13.

However, the resulting recovery force of the elastic composite yarn is lower as the first elastic performance filament 11 does provide a smaller recovery force compared to common elastic composite yarns having two elastic performance filaments providing identical elastic recovery forces.

However, if large elongation stress is applied to the elastic composite yarn 1, the first performance filament 11 additionally provides recovery forces supporting the second performance filament 13. Therefore, recovery forces of the filamentary core 3 according to the present disclosure are still provided even if strong elongations are applied to the filamentary core 3. However, the inelastic control filament 15 provides a safety function in that an overstretching of the elastic yarn 1 is avoided. Even the inelastic control filament 15 is stretched beyond its elasticity limit, the strong recovery forces within a broad range because of the different draft ratios provides best recovery forces even in that case.

A fabric, particularly denim, produced on the basis of the elastic composite yarn 1 according to the present disclosure do not suffer from the above-mentioned problem of a "corset". Further, the growth effect is much reduced, as even in strong elongation stresses, recovery forces (particularly caused by the elastic performance filament having a lower draft ratio) can still be provided.

FIG. 22 illustrates the behavior of a filamentary core and/or a common elastic composite yarn in comparison with a filamentary core and/or an elastic composite yarn according to the present disclosure. This figure illustrates the behavior of the stress or recovery force depending on the elongation of the filamentary core and/or the elastic composite yarn.

The dashed lines represent the elastic behavior of a single elastic performance filament being a filamentary core having a mass of 70 Denier and of a single elastic performance filament being a filamentary core having a larger mass, namely 140 Denier.

As visible, for the single 70 Denier filament, low forces F are rendered, even though the elongation e gets quite high. In contrast thereto, if one doubled the material for the single elastic performance filament (140 Denier) strong recovery forces F or stress will be applied by the filamentary core or yarn with small elongations. Both known filamentary cores having only one elastic performance filament (each different sized) suffer from either the disadvantage of the "corset"-phenomena or the "slaggy" look.

According to the present disclosure, providing a filamentary core having a force shifting mechanism particularly realized by different draft ratios for the at least two elastic performance filaments, the filamentary core 3 or the elastic composite yarn 1 according to the present disclosure provide two adjusted behavior zones, namely a comfort zone and a power zone. The election of draft ratio difference defines the shifting point (breaking point) between a low gradient of force growth and a high gradient of force growth. The behavior of the filamentary core or the elastic composite yarn is drawn with a full line.

Within the comfort zone, for instance in the area of legs, low recovery force shall be applied therefore, the user of the textile material manufactured by the elastic composite yarn or the filamentary core does not suffer of the so-called "corset"-effect. However, in areas like the knee area, where high forces are applied, stronger recovery forces are applied in order to bring back the strong tension area into its original shape. Therefore, the textile material does not "slaggy".

In the table illustrated in FIG. 23, different examples of a filamentary core and/or an elastic composite yarn choosing different physical parameters for the elastic performance filament are noted in order to provide different elasticity behavior depending on the elongation of the elastic composite yarn 1.

Examples 1, 3, 5, 7, 9, 11, 13, 16, 17, 19, 20, 23, 25, 27 and 29 relate to filamentary cores and/or elastic composite yarns all comprising two elastic performance filaments 11, 13 and an inelastic control filament 15.

Examples 2, 4, 6, 8, 10, 12, 14, 15, 18, 21, 22, 24, 26 and 28 refer to a filamentary core or an elastic composite yarn having only two elastic performance filaments 11, 13 without an inelastic control filament 15.

Figure 4A:
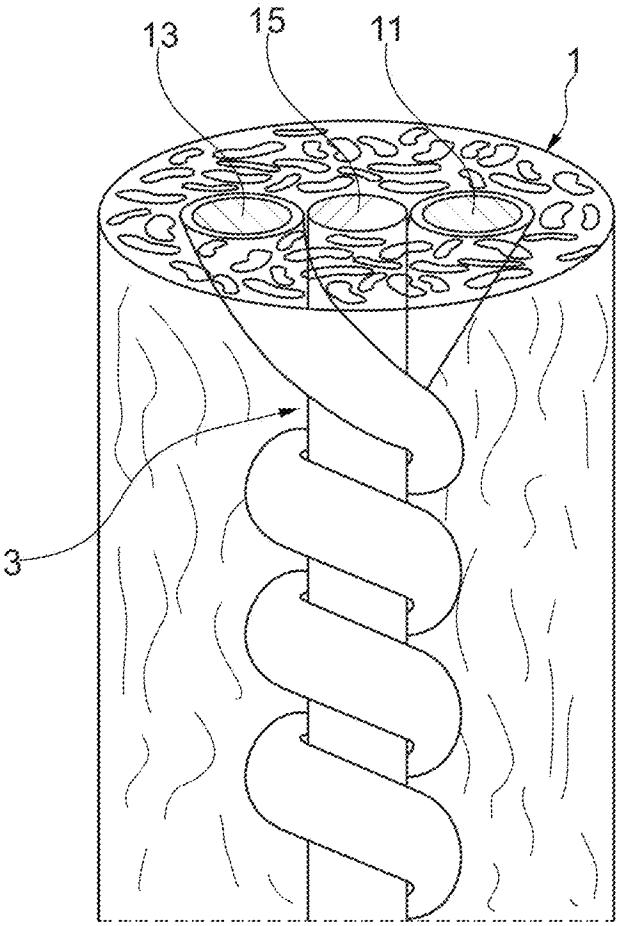

Regarding the further embodiment according to FIGS. 4*a*, *b* and 5 for the sake of a better legibility of the description of the figures, the same reference signs are used for similar or identical elements of the elastic composite yarn 1 according to the present disclosure, as mentioned above.

Figure 4B:
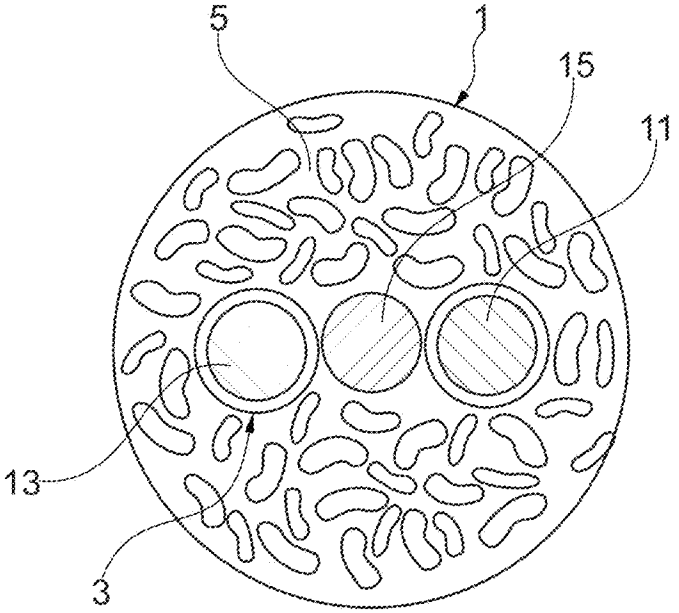
Figure 5:
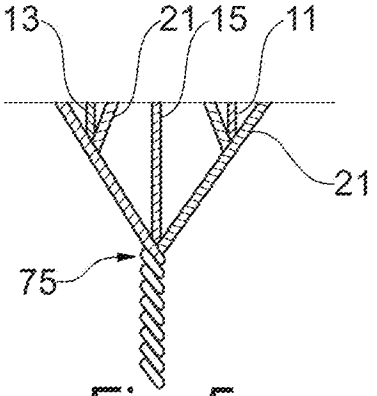
FIG. 5 is a schematic side view on the manufacturing process step of making the elastic composite yarn according to the embodiment of FIGS. 4*a* and 4*b;*

The embodiment of FIG. 4*a*, 4*b* is identical with respect to the embodiment of FIG. 3*a* with respect to the filamentary core 3. However, a different fibrous sheath 5 is used. In contrast to the fibrous sheath 5 according to FIG. 1, the fibrous sheath 5 according to FIGS. 3 and 4 are shaped irregularly. However, the elastic behavior of the elastic composite yarn 1 is equal as described according to the above-mentioned example.

According to both embodiments, particularly in view of FIGS. 3*b* and 4*b*, concerning the manufacturing process step for unifying the at least two elastic performance filaments 11, 13 and the inelastic control element 15 within the fibrous sheath of the elastic composite yarn 1, the spinning station is positioned upstream the merging station 75 in that the fibers, as cotton fibers, first are spun around the respective elastic performance filaments 11, 13 separately by using separate rovings 21. The inelastic control filament 15 remains "naked", i.e. without any fibers for the time being. In the merging station 75, both elastic performance filaments 11, 13 already surrounded by the fibrous sub-sheath 5 and the inelastic control filament 15 are merged together by a twisting action T by which the composite yarn 1 is realized.

Figure 6:
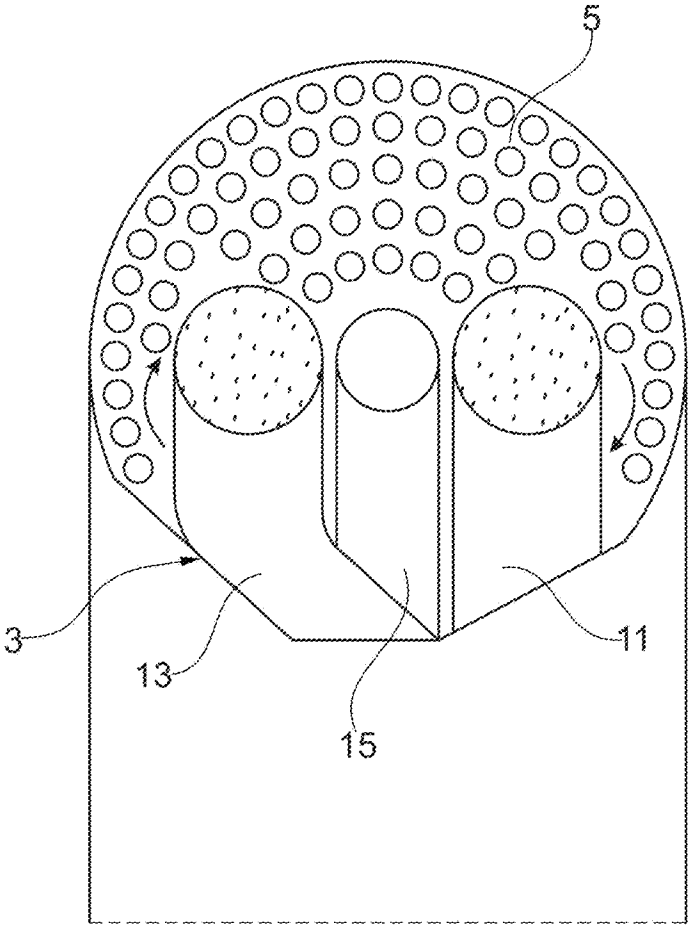
FIG. 6 is a schematic perspective and section view of the elastic composite yarn including a filamentary core according to a fifth exemplary embodiment of the present disclosure.

According to FIGS. 6 and 7 a fifth embodiment of the inventive composite yarn 1 is shown, however, in order to make the description of figures easier to read, for the same or identical components of the yarn the same reference signs are used.

The elastic composite yarn 1 according to FIGS. 6 and 7 differs from the above-mentioned embodiment of FIGS. 3*a* and 3*b* in the manufacturing step in that, first, the inelastic control filament 15 (and not filaments 11, 13) is surrounded by the roving 21. In this regard, only one roving 21 is used.

Upstream a spinning action T, the merging station 75 is positioned, in which the at least two elastic performance filaments 11, 13 are integrated into the roving 21 becoming the sheath 5. When merging the at least two elastic performance filaments 11, 13 (naked) a twisting action T is performed, particularly to connect the at least two elastic performance filaments with the inelastic control filament 21, so as to form the filamentary core 3.

The sixth embodiment of an elastic composite yarn 1 according to FIGS. 8, 9 and 10 differs particularly to the yarn 1 of FIGS. 6, 7 in the specific use of different fiber material for making the roving 21 and therefore the main sheath 5. The manufacturing is similar to the one described to the third embodiment according to FIGS. 6 and 7. In FIGS. 11 to 18 different arrangements for producing the filamentary core 3 and/or the elastic composite yarn 1 is shown and generally associated with reference sign 51. In the following, the components/stations, action of points of the arrangement 51 for producing the filamentary core 3 and/or the elastic composite yarn 1 according to the present disclosure are described.

In FIG. 11, a manufacturing process for making a filamentary core 3 according to the present disclosure is generally shown. Said arrangement 51 comprises two sources of the first and second performance filament 11, 13 provided on bobbins 91, 93 which are in cooperation with adjacent driving drums for delivering the elastic performance filament 11, 13.

Downstream the conveying direction M the respective drafting devices 95, 97 are arranged for independently generating eventual different draft ratios for the two elastic performance filaments 11, 13 before they are unified in a known jet device 101.

Parallel to the sources of elastic performance filaments 11, 13 a source of an inelastic control filament 15 is associated to reference number 103. The inelastic control filament 15, like PES, PBT, T400 is delivered by a transport device 105 for joining with the two elastic performance filaments 11, 13 in the jet device 101. A further drafting cylinder 107 may be arranged downstream the jet device.

In the jet device the three filaments 11, 13, 15 are twisted and/or intermingled according to the required performance of the filamentary core 3. After a traverse 111, the realized filamentary core having two elastic performance filaments 11, 13 comprising two different draft ratios, and an inelastic control filament 15 is stocked on a bobbin 115.

In the following, particularly attention is drawn to the arrangement 51 as shown particularly for making the elastic composite yarn 1 or even only a filamentary core 3 if rovings for a fibrous sheath 5 are not involved.

Considering the supplying direction M of the rovings/filaments 11, 13, 15, 15*a*, 15*b*, 21, 21*a*, 21*b*, the arrangement 51 comprises a crill-mounted supply 53 eventually for one, two or more rovings 21, 21*a*, 21*b* of stable fibers of cotton and for the at least two elastic performance filaments 11, 13 and eventually for the one or more inelastic control filaments 15, 15*a*, 15*b*. The arrangement 51 shown in FIGS. 12 to 18 is structured so as to manufacture the filamentary core 3 and/or the elastic composite yarn 1 according to the present disclosure.

Filaments 11, 13, 15, 15*a*, *b* and rovings 21, 21*a*, 21*b* are pulled down from respective bobbins of the crill-mounted supply 53 in a supplying direction M towards the merging station/position 75. For pulling down the filaments 11, 13, 15, 15*a*, *b* and rovings 21, 21*a*, 21*b* a pulling force is generated and determined by the general turning action of the final yarn package or a bobbin 81 turning and requiring a certain amount of fibers and filaments in order to form yarn 1 and/or core 3. By the turning action of the yarn package 81 all strands, i.e. filaments and rovings, are pulled from the crill-mounted supply 51.

Downwards the crill-mounted supply 51, a pretension device 63 in form of a cylindrical bar is arranged, for deflecting the filaments 11, 13, 15, 15*a*, 15*b* and rovings 21, 21*a*, 21*b*.

If rovings 21, 21*a*, 21*b* are foreseen, from the pretension device 63 they are guided into a conditioning device 66 which is only relevant foreseen for the arrangement 51 of FIGS. 12 to 15.

A draft ratio generation is provided for each of the arrangements 51 according to FIGS. 11 to 20, in order to establish different draft ratios for the elastic performance filaments 11, 13, i.e. different tensile tension (different quantity of elastic material of the filament per length unit of core (3) or yarn (1)) within the elastic performance filaments 11, 13, when forming the elastic composite yarn 1/filamentary core 3 with the process of the arrangement 51.

For generating the draft ratio, the respective filament 11, 13 is pulled-off from the bobbins by the general core or yarn speed and the draft ratio is adjusted by increasing or decreasing a resistance force acting against the pulling force. The higher the resistance force is the larger the respective draft ratio for the filament, and vice versa. Therefore, according to the present disclosure, the first and the second elastic performance filament 11, 13 are provided to form the elastic composite yarn 1 having different tensile stress generated by different pulling resistance submitted to the respective elastic performance filament 11, 13. The draft ratio of the specific elastic performance filament 11, 13 within the filamentary core 3/elastic composite yarn 1 can be defined by a speed difference between the general core- or yarn-speed and the specific unwrapping speed of the specific elastic performance filament 11, 13 from their respective bobbin. The general core- or yarn-speed is determined by a driven bar 99 adjacent to the merging station 75. The core 3 or yarn 1 is driven onto the final yarn package or bobbin 81 by said (final) driven bar 99. If the unwrapping speed of the respective elastic performance filament 11, 13 from its bobbin is identical to the core- or yarn-speed generated by the final driven bar 99, the draft ratio of the elastic performance filaments 11, 13 is one (1), i.e. the elastic performance filaments are not pretentioned. According to a non-limiting example, the filamentary core 3 or yarn has a general core- or yarn-speed of 10 m/min. The final bar 99 is driven accordingly. The respective supporting bar 62*c*, 62*d* is controllable driven or frained in order to adapt the unwrapping speed of the respective elastic performance filament 11, 13. If the unwrapping speed is reduced below 10 m/min., the draft ratio becomes larger than 1. In the case, the elastic performance filament 11 is unwrapped with a speed of 5 m/min, half of the material is provided to the filamentory core 3 or elastic composite yarn 1 compared to the general yarn- or core-speed of 10 m/min. This results into a draft ratio of 2.0. The elastic performance filament 11 is pretensioned accordingly. If the second elastic performance filament 13 is unwrapped by a speed of 2.5 m/min., the elastic performance filament 13 is even stronger stretched and receives a draft ratio of 4.0. The draft ratio difference between the two elastic performance filaments 11, 13 is 2.0.

Upstream the merging station 75, a centering and guiding device 61 is foreseen so that the merging action at the merging station 75 is safely and properly performed. Said guiding and centering device 61 can particularly be seen in embodiments of FIGS. 12 to 15 and can be integrated into each arrangement 51. The guiding and centering device 61 can be more clearly identified in FIG. 21. The guiding and centering device according to a preferred embodiment is formed by a rotating drum structure 72 for receiving all of the at least two elastic performance filaments 11, 13 and eventually the at least one inelastic control filament 15, 15*a*, 15*b*. Said guiding drum structure 72 comprises three disc wheels 65*a*, 65*b*, 65*c* independently rotatably and idlingly supported with respect to a stationary rotation axis R (FIG. 20). Each of the wheels 65*a*, 65*b*, 65*c* has a circumferential groove 71*a*, 71*b*, 71*c* in cross-section being V-shaped. The grooves 71*a*, 71*b*, 71*c* are axially positioned in an equal distance to each other. The center groove 71*b* receives the inelastic control filament 15. Each of the filaments 11, 13, 15, 15*a*, 15*b* is received at the pointed line bottom of each groove. The circumferential speed of each disc 65*a-c* is adapted to the unwrapping speed of the respective filament 11, 13, (15) so that the draft ratio within the filament 11, 13 (15) is not or at least minimally influenced by the guiding and centering device.

Turning to FIG. 16, an alternative arrangement 51 may not comprise own draft ratio generator 61, rather, an already pre-stressed elastic performance filament 11, 13, already combined to an inelastic control filament 15 for forming a sub-filamentary core 30, is introduced into the arrangement 51. That means that the sub-filamentary core 30 consisting of one elastic performance filament 11 and one inelastic control filament 15 was realized with a certain first draft ratio via a pre-manufacturing. Said first manufactured sub-filamentary core 30 having an elastic performance filament 11 with a first draft ratio is supplied by the bobbin 69, respectively. The filamentary core 3 being a combination of two sub-filamentary cores 30 having elastic performance filaments 11, 13 with different draft ratios does not comprise a fibrous sheath 5. The two sub-filamentary cores 30 are merged at the merging station 75 in order to establish the filamentary core 3. As the two elastic performance filaments 11, 13 in the respective sub-filamentary core 30 do have two different draft ratios, the resulting filamentary core 3 includes two elastic performance filaments 11, 13 having two different draft ratios.

Referring to FIGS. 17 and 18, the arrangement 51 for producing the filamentary core 3 or elastic composite yarn 1 are shown in two different types. The arrangement 51 according to FIG. 17 manufactures the filamentary core 3 having the identical structure as the filamentary core 3 manufactured by the arrangement 51 according to FIG. 18. The filamentary core 3 consists only of two elastic performance filaments 11, 13 and two inelastic control filaments 15*a* and 15*b*.

However, the arrangements according to FIGS. 17 and 18 have an own draft ratio generator 60 integrated which is shown in detail in FIGS. 19 and 20.

Each draft ratio generator 61 comprises two pairs of bars 62*a*, 62*b* and 62*c*, 62*d* supported by a frame structure 64. The bars 62*a* to 62*d* receive the respective bobbins for the elastic performance filaments and the inelastic control filaments. Each pair of bars 62*a*, 62*b* and 62*c*, 62*d* are driven by servo engines 68, 68*a*, 68*b*, 68*c*, 68*d*.

According to the embodiment of FIG. 19, the draft ratio generator 61 comprises only one servo engine for each pair of bars 62, 62*b* or 62*c*, 62*d*, the respective servo engine 68 driving the two bars 62*a*, 62*b* with the different circumferential speed by means of a belt 74. Different circumferential speeds are generated by different radiuses of the driven cylindrical bars 62*a*, 62*b*. According to the radius of the bars, the delivery speed for bobbins of elastic filaments 11, 13 be adjusted for generating the desired draft ratio difference.

For the embodiment according to FIG. 20, each bar 62*a* to 62*d* is associated to its own servo engine 68*a* to 68*d* and an own belt 74*a* to 74*d*.

On the pair of bars 62*a*, 62*b* and 62*c*, 62*d* a weight role 83 (FIGS. 16, 17) is placed for loading the elastic performance filament 11, 13 so that a draft ratio is generated and adjusted according to the circumferential speed of the respective pair of bars 62*a*, 62*b* and 62*c*, 62*d*.

In order to generate different draft ratios, the respective speed of the bars 62*b* and 62*c* are different, as explained above.

The respective draft ratio is differently generated within the filaments 11, 13, (15, 15*a*, 15*b*) particularly different between the draft ratios of the elastic performance filaments 11, 13, the filaments 11, 13, 15, 15*a*, 15*b* leave the draft ratio generator system 61 downstream in order to enter the ring-spinning station 73 (FIG. 12). At the ring spring station 73 eventual rovings 21*a* and 21*b*, respectively are spun around the elastic performance filaments 11 and 13, respectively, the spinning direction T for both spinning actions applied to the elastic performance filaments 11, 13 are the same.

Particularly downstream the ring-spinning station 73, a merging station 75 is arranged at which the two elastic performance filaments 11, 13 (FIG. 13; surrounded by a fibrous sub-sheath 21*a*, 21*b*), eventually the clean or naked inelastic control filament 15 with or without having received fibrous material and eventually the roving(s) 21, 21*a*, 21*b* are merged together by an continuous spinning action T*. Subsequent said merging station 75 the finalized elastic composite yarn 1 is received on a yarn package (bobbin) 81 realized as a bobbin onto which the yarn 1 is wounded.

As seen in FIG. 21, each of the disc wheels 65*a*, 65*b*, 65*c* can be driven independently from each other by at least one or two drive shafts 67 turning about the rotation axis R. If the two disc wheels 65*a*, 65*b* receiving the elastic performance filaments 11, 13 are driven (or retarded) simultaneously and by the same speed, the draft ratio of the elastic performance filament 11, 13 would be equal. According to one aspect of the present disclosure, the draft ratio of the elastic performance filaments 11, 13 shall be different in order to provide the desired different elastic behavior for the elastic performance filaments 11, 13.

In the arrangement 51 for producing the elastic composite yarn 1, (FIG. 14) the inelastic control filament 15 and both elastic performance filaments 11, 13 having different draft ratios, are merged together at the merging station 75. By the twisting rotation T, the elastic composite yarn 1 is realized and delivered to the yarn package 81. The inelastic control filament 15 may comprise a draft ratio which was also generated by the draft ratio generator 61 according to the above-mentioned explanations regarding the draft ratio generator 61 in FIG. 19, 20 or 21.

The arrangement 51 according to FIG. 15 differs from the one of FIG. 14 only with respect to the arrangement of the bobbin for the inelastic control element being a PES.

Referring to the arrangement 51 of FIG. 17, downstream of the draft ratio generator 61, the two elastic performance filaments 11, 13 as well as the two inelastic control filaments 15*a*, 15*b* are deflected by guiding hooks 85 to be lead to a merging ring 87 forming the merging station 75. At this position the four filaments 11, 13, 15*a*, 15*b* are merged together in order to form the elastic composite yarn not having a fibrous sheath 5.

Said elastic composite yarn 1 only existing of a filament core 3 comprising the two elastic performance filaments 11, 13 and the two inelastic control filaments 15*a*, 15*b*, is received by a yarn package 81 turning in order to also provide the general pulling force. Said elastic composite yarn 1 according to the manufacturing process of FIG. 17 does have two elastic performance filaments 11, 13 having different draft ratios.

According to FIG. 18, an elastic composite yarn 1 is realized that has two elastic performance filaments 11, 13 which is covered by a fibrous sheath 5 formed by two separated rovings 21*a*, 21*b*. Downstream the draft ratio generator 61, the two elastic performance filaments 11, 13 having two different draft ratios as well as the two rovings 21*a*, 21*b* are led by guiding hooks 85 to a merging ring 87 forming the merging station 75. The elastic composite yarn 1 is received by the yarn package 81 at the end of the manufacturing process.

In general, said elastic composite yarns 1 comprise at least two elastic performance filaments 11, 13 that particularly provide two different elasticity behaviors. The first elastic performance filament comprising a high draft ratio of e.g. 2.5 or more fulfils recovery of the elastic composite yarn in that it immediately applies strong recovery forces in case of low stress elongation of the yarn 1 and consequently the fabric made of the yarn 1. Meanwhile the second elastic performance filament having a lower draft ratio of e.g. 1.5, is more or less inactive (still low recovery, so that a too strong overall recovery force is avoided). The negative phenomenon "corset" is also avoided. However, if elongation stretch is extraordinary high, e.g. in the area of knees and the back of trousers, the elastic composite yarn is stretched 2 to 5 times of its length, the second elastic performance filament gets active providing strong recovery forces so that "baggy" areas are avoided when the elastic composite yarn 1 according to the present disclosure is used.

The features disclosed in the above description, the figures and the claims may be significant for the realisation of the present disclosure in its different embodiments individually as in any combination.

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

LIST OF REFERENCE SIGNS

1 elastic composite yarn
3 filamentary core
5 fibrous cotton sheath
10 contact surface
11, 13 elastic performance filament
15, 15*a*, 15*b* inelastic control filament
21, 21*a*, 21*b* fibrous material/roving
30 sub-filamentary core
43 supply
51 arrangement for producing elastic composite yarns 1
53 crill-mounted supply
60 draft ratio generator
61 guiding and centering device
62*a*, 62*b*, pair of bars
62*c*, 62*d* pair of bars
63 pretention device
64 frame structure/press role
65*a*, 65*b*, 65*c* disc wheel
66 preconditioning device
67 drive shaft
68, 68*a*, 68*b*, 68*c*, 68*d* servo engine
69 bobbin
70 spinning system
71*a*, 71*b*, 71*c* circumferential groove
72 guiding drum structure
73 ring-spinning station
74, 74*a*, 74*b*, 74*c*, 74*d* belt
75 merging station
81 yarn package
83 weight role
91, 93, 115 bobbin
95, 97 drafting device
99 final driven bobbin
101 jet device
103 source for inelastic filament
105 transport device
107 drafting cylinder
e elongation
F recovery forces
M conveying/supplying direction
R stationary rotation axis
T, T* spinning/twisting direction

The invention claimed is:

1. A filamentary core for an elastic composite yarn, comprising:

at least two elastic performance filaments, and at least one inelastic control filament being incapable of being stretched beyond a maximum length without permanent deformation, said maximum length being less than 1.5 times of its package length, wherein:

each of the at least two elastic performance filaments has a different elastic behavior, and each of the at least two elastic performance filaments is configured to:

be stretchable at least about 2 times its package length, and have at least 90% up to 100% elastic recovery after having being released from a stretching of 2 times its package length.

2. The filamentary core according to claim 1, wherein:

the at least two elastic performance filaments engage each other providing an interrupted or continuous contact area or surface along a longitudinal direction of the filamentary core, the contact area or surface is realized by twisting and/or intermingling the at least two elastic performance filaments, and when elongating the elastic composite yarn, the respective recovery forces applied by said at least two elastic performance filaments differ from each other.

3. The filamentary core according to claim 1, wherein:

the at least two elastic performance filaments are twisted and/or intermingled such that a continuous, helical friction contact between the at least two elastic performance filaments is provided and/or at least partly, additional friction increasing elements are held due to the at least two twisted and/or elastic performance filaments inbetween the filaments, and/or the at least two elastic performance filaments are connected to a further inelastic filament, an interconnection being realized in that a first of the at least two elastic filaments is twisted and/or intermingled with the inelastic filament according to a first manufacturing operation and the twisted and/or intermingled pair of inelastic filament and the elastic performance filaments are connected to a second elastic performance filament by twisting and/or intermingling, and additional friction increasing elements are held and/or clamped in-between the respective filaments.

4. The filamentary core according to claim 1, wherein:

for a given elongation of the filamentary core of 1.2, 1.5, 2.0, 2.5 and/or 3.0 times its package length or for a given elongation area of 1.0 to 2.0 times its package length, said at least two elastic performance filaments of the filamentary core provide different recovery forces, and/or said at least two elastic performance filaments of the filamentary core are structured and/or configured to have different moduli of elasticity for a common elastic elongation along essentially, at least 50%, at least 80% or the entire elastic elongation of the elastic composite yarn.

5. The filamentary core according to claim 1, wherein:

the filamentary core is configured to provide a non-linear stress-strain-behavior having a non-linear, non-parabolic and/or a kinked course, the stress-strain-behavior denoting a breaking point at which a stress gradient depending on a continuous elastic elongation of the filamentary core is discontinued in that an inclination of the stress gradient with respect to a continued elongation abruptly changes, an elongation area below the breaking point establishes a comfort zone having a low stress gradient, and an elongation area above the breaking point provides a high stress gradient.

6. The filamentary core according to claim 1, further comprising:

a force shifting mechanism configured to boost a bouncing back force of the filamentary core, said force shifting mechanism defining a predetermined shifting point depending on the rate of elastic elongation of the filamentary core, wherein:

said force shifting mechanism is preset such that, when initiating elongation of the filamentary core, the elastic recovery force applied by the elongated filamentary core is realized by at least one active elastic performance filament of the at least two elastic performance filaments and the other of the at least two elastic performance filaments remains in a passive status according to which said other of the at least two elastic performance filaments essentially does not render a recovery force, said shifting point is set to be at a predetermined elongation rate of the filamentary core upon which the other of the at least two elastic performance filaments is initiated to become active in applying a recovery force, and said force shifting point is set for an elongation of the filamentary core of more than 0% or 5% of a package length of the filamentary core and less than 100% of the package length of the filamentary core.

7. The filamentary core according to claim 1, wherein:

a first elastic performance filament of the at least two elastic performance filaments of said filamentary core has a first draft ratio being at least 1.0 or at least 2.0, a second elastic performance filament of the at least two elastic performance filaments of said filamentary core has a second draft ratio being lager than 0.1, 0.2, 0.3, 0.5, 1.0, 1.5, or 2.0, and the first and the second draft ratios differ from each other by at least 0.1, 0.2, 0.3, 0.5, 0.8, or 1.0.

8. The filamentary core according to claim 1, wherein:

the filamentary core further comprises a third elastic performance filament including a third draft ratio being equal to one of the first or second draft ratios or differing from the first or second draft ratios in at least 0.1, 0.5, 0.8 or 1.0, and the respective difference between the third draft ratio to the respective other draft ratios is larger than 0.1, 0.3 or 0.5 and/or lower than 2.0.

9. The filamentary core according to claim 8, wherein said first draft ratio is between 1.0 and 2.0 and the second draft ratio is at least 1.5, and/or the at least two elastic performance filaments and the third elastic performance filament have a respective draft ratio being lower than 5.0; 4.5; 4.0; 3.5; 3.0; 2.5 or 2.0.

10. The filamentary core according to claim 1, wherein the at least two elastic performance filaments forming said filamentary core are differently structured in that, elastically stretching the at least two elastic performance filaments under unmounted condition of at least about 1.2, 1.5, 2.0 and/or 3.0 times their package length, respective recovery forces of the at least two elastic performance filaments differ from each other, the recovery force of a first elastic performance filament of the at least two elastic performance filaments being at least 3%, 10% or 20% larger than the second recovery force of a second elastic performance filament of the at least two elastic performance filaments.

11. The filamentary core according to claim 1, wherein:

the at least two elastic performance filaments forming said filamentary core comprise different thickness, said thickness difference being larger than 2 or 5 Denier, and the thickness for the at least two elastic performance filaments is chosen from 20, 40, 70, 105, and 140 Denier.

12. An elastic composite yarn comprising:

the filamentary core according to claim 1; and a fibrous sheath comprising staples or fibers surrounding the filamentary core, wherein the fibers are cotton fibers, wool fibers, polyester fibers, rayon fibers and/or nylon fibers.

13. A fabric made of the elastic composite yarn according to claim 12, wherein the elastic composite yarn is woven or knitted.

14. A method for producing a filamentary core, comprising:

providing separately at least two elastic performance filaments configured to be stretchable at least about 2 times its package length and have at least 90% up to 100% elastic recovery after having being released from a stretching 2 times its package length, each of the at least two elastic performance filaments having a different elastic behavior; and providing at least one inelastic control filament being incapable of being stretched beyond a maximum length without permanent deformation, said maximum length being less than 1.5 times of its package length.

15. The method according to claim 14, wherein said at least two elastic performance filaments are applied with two different draft ratios, the draft ratios differing from each other in at least 0.1; 0.2; 0.3; 0.4; 0.5; 0.7 or 1.0.

16. The method according to claim 14, further comprising:

intermingling and/or twisting said at least two elastic performance filaments to join said at least two elastic performance filaments to form said filamentary core; and/or providing a fibrous sheath around said at least two elastic performance filaments and/or said at least one inelastic control filament, or providing the fibrous sheath around said filamentary core.

17. The method according to claim 14, further comprising:

providing at least two separate rovings of fibers configured to make a fibrous sheath; and spinning a fibrous sub-sheath around each elastic performance filament and/or said inelastic control filament before merging the at least two elastic performance filaments and said at least one inelastic control filament to form the filamentary core, wherein said at least one inelastic control filament without having received the fibrous sub-sheath is merged with said at least one inelastic control filament covered with said fibrous sub-sheath.

18. The filamentary core according to claim 1, wherein the at least two elastic performance filaments have different thicknesses, a thickness difference between the at least two elastic performance filaments being larger than 10 Denier.

19. The filamentary core according to claim 1, wherein the at least two elastic performance filaments are helically or spirally wound or spun around the at least one inelastic control filament.

20. The filamentary core according to claim 1, wherein the at least two elastic performance filaments are connected with each other by a plurality of connecting points.

21. The filamentary core according to claim 20, wherein the plurality of connecting points are heat-molded connecting points.

22. The filamentary core according to claim 1, wherein the at least two elastic performance filaments and the at least one inelastic control filament are connected with each other by a plurality of connecting points.

23. The filamentary core according to claim 22, wherein the plurality of connecting points are heat-molded connecting points.

* * * * *